US008106929B2

(12) United States Patent
Ozawa et al.

(10) Patent No.: US 8,106,929 B2
(45) Date of Patent: Jan. 31, 2012

(54) PEAK INTENSITY LEVEL CONTROL DEVICE, SELF LIGHT-EMITTING DISPLAY DEVICE, ELECTRONIC DEVICE, PEAK INTENSITY LEVEL CONTROL METHOD, AND COMPUTER PROGRAM

(75) Inventors: Atsushi Ozawa, Kanagawa (JP); Mitsuru Tada, Kanagawa (JP)

(73) Assignee: Sony Corporation, Tokyo (JP)

( * ) Notice: Subject to any disclaimer, the term of this patent is extended or adjusted under 35 U.S.C. 154(b) by 1032 days.

(21) Appl. No.: 12/000,703

(22) Filed: Dec. 17, 2007

(65) Prior Publication Data

US 2008/0150970 A1 Jun. 26, 2008

(30) Foreign Application Priority Data

Dec. 26, 2006 (JP) ..... 2006-349268

(51) Int. Cl.
*G09G 5/10* (2006.01)

(52) U.S. Cl. ..... 345/690; 345/76; 345/77; 345/82; 345/83; 345/84; 345/89; 345/691

(58) Field of Classification Search ..... 345/76–84, 345/690–691, 89
See application file for complete search history.

(56) References Cited

FOREIGN PATENT DOCUMENTS

| | | |
|---|---|---|
| JP | 2003-134418 | 5/2003 |
| JP | 2005-049751 | 2/2005 |
| JP | 2005-275047 | 10/2005 |

*Primary Examiner* — Richard Hjerpe
*Assistant Examiner* — Saifeldin Elnafia
(74) *Attorney, Agent, or Firm* — Rader, Fishman & Grauer PLLC

(57) ABSTRACT

A peak intensity level control device that controls a peak intensity level in a self light-emitting display module of an active matrix driving type is disclosed. The device includes: an average picture value calculation section that calculates an average picture value of display data to be supplied to the self light-emitting display module; a driving condition control section that controls, at a time of performing intensity-up driving with respect to the peak intensity level, a driving condition of the self light-emitting display module so as to be able to derive the peak intensity level suited for the average picture value; and a gamma change section that applies, at the time of performing the intensity-up driving with respect to the peak intensity level, a gamma change to the display data so as not to increase power consumption compared with driving with the peak intensity level of a standard value.

11 Claims, 26 Drawing Sheets

VERTICAL SYNCHRONIZING SIGNAL

DUTY CONTROL SIGNAL (LIGHT-ON TIME: SHORT)

DUTY CONTROL SIGNAL (LIGHT-ON TIME: LONG)

PEAK INTENSITY LEVEL CONTROL DEVICE, SELF LIGHT-EMITTING DISPLAY DEVICE, ELECTRONIC DEVICE, PEAK INTENSITY LEVEL CONTROL METHOD, AND COMPUTER PROGRAM

CROSS REFERENCES TO RELATED APPLICATIONS

The present invention contains subject matter related to Japanese Patent Application JP 2006-349268 filed in the Japanese Patent Office on Dec. 26, 2006, the entire contents of which are incorporated herein by reference.

BACKGROUND OF THE INVENTION

1. Field of the Invention

The invention of this specification relates to a technology of enhancing the appearance of a display screen without increasing the power consumption of a self light-emitting display module of the active matrix driving type.

The invention also relates to a peak intensity level control device, a self light-emitting display device, an electronic device, a peak intensity level control method, and a computer program.

2. Description of the Related Art

A growing number of electronic devices have been recently equipped with a liquid crystal display, but the liquid crystal display has problems of narrow viewing angles and slow response speeds.

As such, an organic EL (electroluminescent) display device free from such technical problems is expected to be the next-generation display device.

The issue here is that the organic EL display devices and other types of self light-emitting devices have another technical problem of requiring a technology for suppressing power consumption and load variation. Establishing such a technology is considered effective in terms of size reduction of a power system, and thus various types of technologies have been under development.

For the recent display devices, there is also a demand for the display of images and videos with satisfactory brightness with a good viewing angle. Such a display, however, is against the demand for the above-described reduction of power consumption, and often instead causes an increase of power consumption. As such, it has been considered difficult to implement, at the same time, images with a good viewing angle, i.e. high-quality images with less power consumption.

SUMMARY OF THE INVENTION

Described below are the technologies that are currently proposed for reducing power consumption and increasing of image quality.

Patent Document 1 (JP-A-2003-134418) describes an ABL (Auto Brightness Level) for not causing viewers to feel something wrong from a visual perspective, or to feel annoyed with digital processing of display data.

The technology of Patent Document 1 enables to restrict the average intensity for display without causing viewers to feel something wrong so that the power consumption can be reduced. The problem with the technology, however, is that the power consumption cannot be freely set with its maximum possible value, thereby failing to control the details of the maximum possible value of the power consumption.

Patent Document 2 (JP-A-2005-275047) describes a technology of estimating power consumption of a display panel with digital processing of display data, and selectively controlling the state of light emission not to exceed the maximum possible level of power consumption.

The technology of Patent Document 2 indeed changes the state of light emission while not causing viewers to feel something wrong, and controls the intensity so as not to exceed the maximum possible level of power consumption. The issue with this technology is that the value used for controlling the power consumption is also constant, i.e. fixed, considering the maximum possible value. This technology thus has the same problems as Patent Document 1.

Actually, the technologies of Patent Documents 1 and 2 are those typically restricting the power consumption in a general attempt to satisfy the maximum possible power consumption for devices. It means that if the value of power consumption is equal to or smaller than the value for control use, no control is applied for the suppression of power consumption, thereby failing to keep track of the differences of the light-emission area and the intensity.

As such, when a display of videos with a lower average picture level (APL) is continuously made, even if intensity-up driving of a peak intensity level successfully enhances the appearance of a display screen, this causes a problem of increasing the power consumption compared with a case of performing no intensity-up driving of the peak intensity level.

Patent Document 3 (JP-A-2005-49751) describes a technology of preventing the reduction of contrast sensitivity by substantially extending the dynamic range of intensity while keeping, to some degree, the effects of a reduction of power consumption. This is achieved by combining a function of reducing the average intensity level of an incoming video signal and a function of changing the peak intensity level in accordance with the average intensity level.

With the technology of Patent Document 3, however, there are problems of not being able to reduce the power consumption to a greater extent than a case with no such technology, and not being able to set any arbitrary level of power consumption.

According to an embodiment of the present invention proposed by the inventors, there is provided a control device that controls a peak intensity level in a self light-emitting display module of active matrix driving type. The device includes: an average picture value calculation section that calculates an average picture value of display data to be supplied to the self light-emitting display module; a driving condition control section that controls, at a time of performing intensity-up driving with respect to the peak intensity level, a driving condition of the self light-emitting display module so as to be able to derive the peak intensity level in accordance with the average picture value that is a calculation result; and a gamma change section that applies, at the time of performing the intensity-up driving with respect to the peak intensity level, a gamma change to the display data so as to not increase power consumption compared with driving with the peak intensity level of a standard value.

Herein, the expression of "intensity-up driving with respect to the peak intensity level" denotes the state in which an image display is made with a peak intensity level higher than a standard value at least partially in a picture area. Note here that such an expression of "intensity-up driving with respect to the peak intensity level" includes a case where the peak intensity level is higher than the standard value entirely in the picture area, and also a case where the picture area varies in peak intensity level, i.e. some portion is of a peak intensity level higher than the standard value, and some portion is of a peak intensity level lower than the standard value.

With such an embodiment of the invention proposed by the inventors, the reduction of power consumption and the increase of image quality both can be achieved at the same time irrespective of the type of display data.

DESCRIPTION OF THE PREFERRED EMBODIMENTS

In the below description, a case of applying embodiments of the invention to an organic EL (electroluminescent) display device, i.e. a self light-emitting display device, of an active matrix driving type is described.

Note here that any components not specifically shown or described in this specification are those of any known or well-known technology in the field of the invention.

Moreover, the embodiments that are described below are no more than examples of the invention, and the invention is surely not restrictive thereto.

A. First Embodiment

A-1. Function Configuration of Organic EL Display Device

Figure 1:
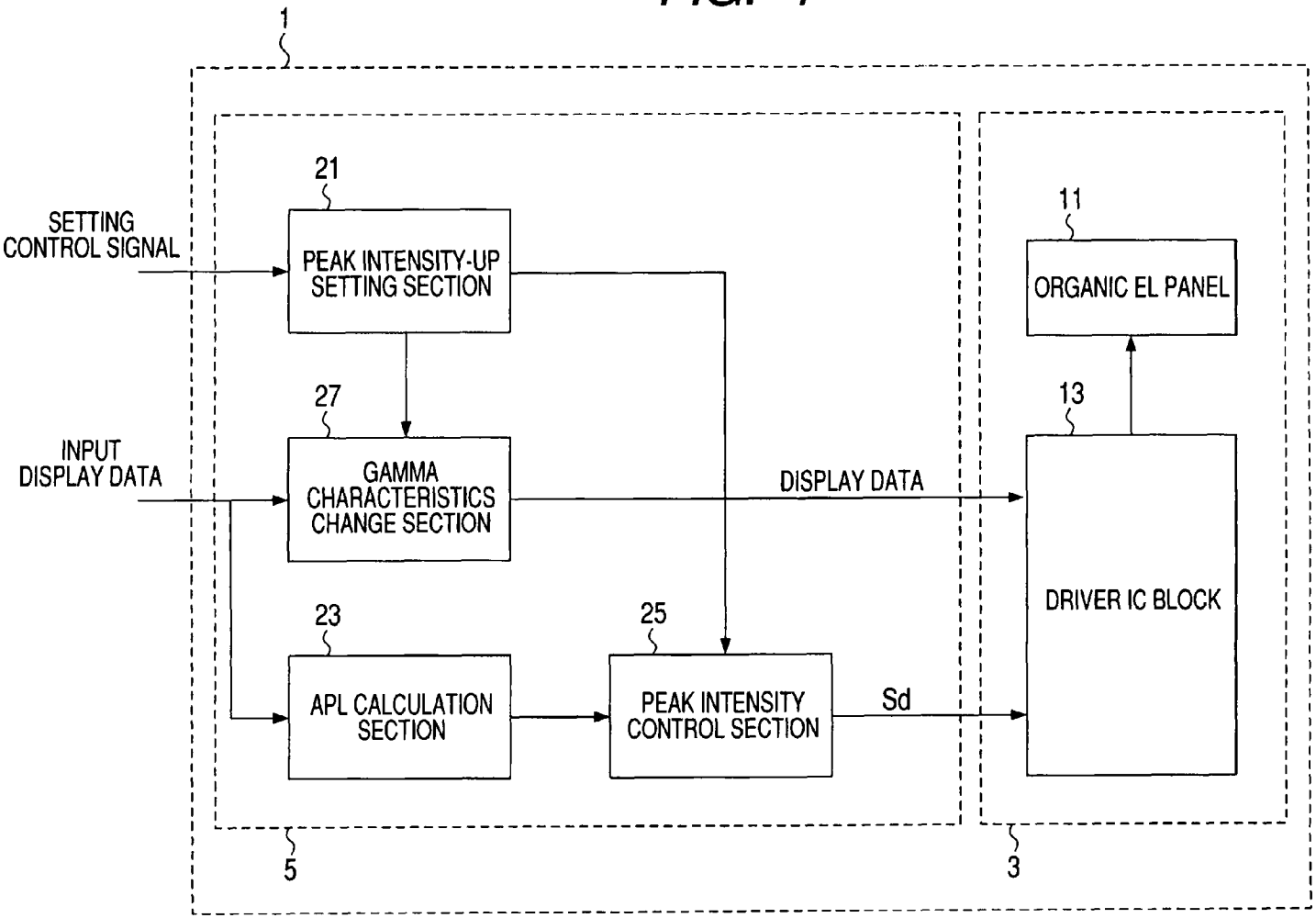
FIG. 1 is a diagram showing an exemplary function configuration of an organic EL display device.

FIG. 1 shows an exemplary function configuration of an organic EL display device 1. The organic EL display device 1 is configured to include an organic EL panel module 3 and a peak intensity level control section 5.

The organic EL panel module 3 is configured to include an organic EL panel 11 and a driver IC (Integrated Circuit) block 13. In the organic EL panel 11, pixels are disposed in a matrix in accordance with a panel resolution.

Among these components, the organic EL panel 11 is for color display use, and therein, the pixels are disposed on a color of light emission basis.

With an organic EL element of a configuration in which the pixels are each laminated with a light-emitting layer of a plurality of colors, every pixel corresponds to various colors of light emission.

Figure 2:
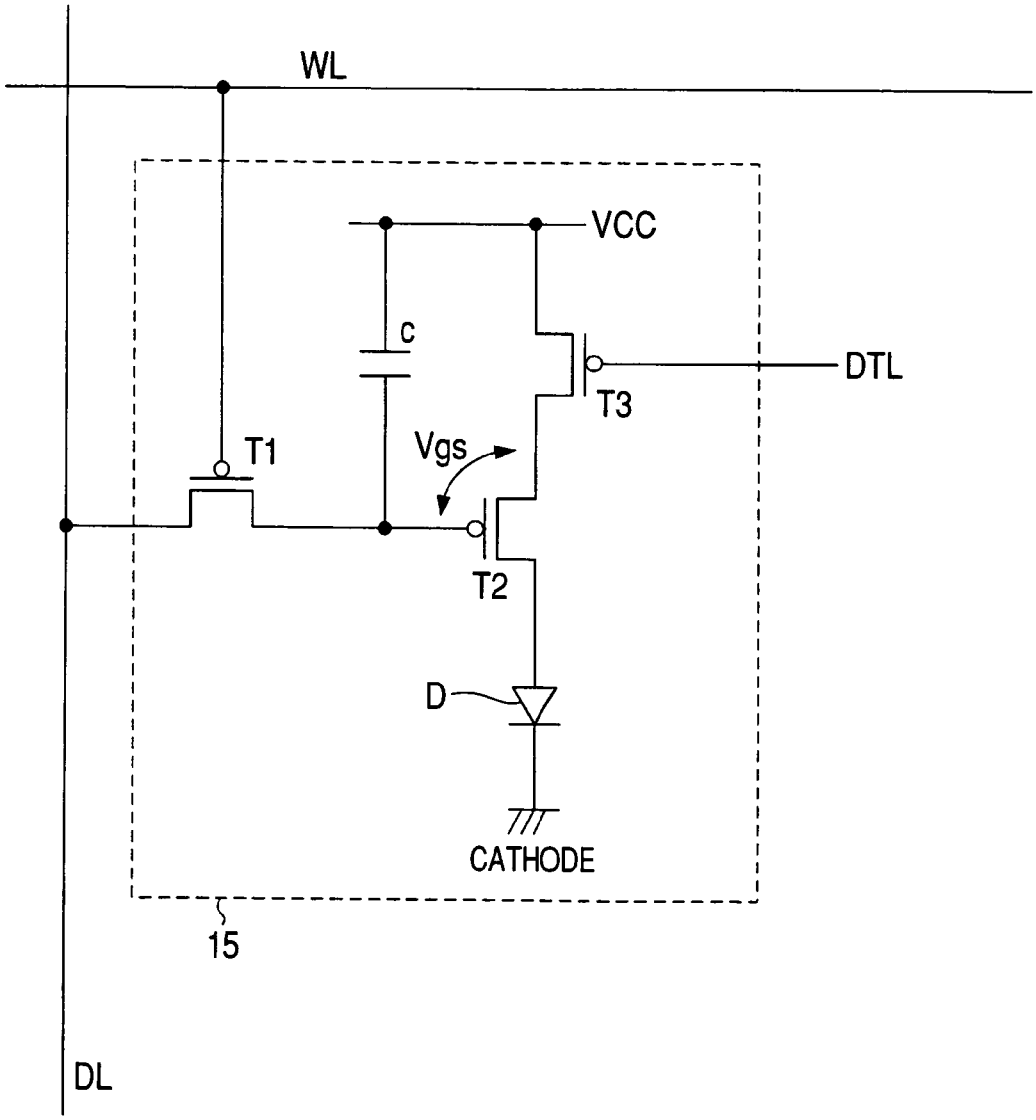
FIG. 2 is a diagram for illustrating the pixel configuration.

FIG. 2 shows the pixel configuration in the organic EL panel 11. A pixel 15 is configured to include a switch element T1, a capacitor C, a current drive element T2, a duty control element T3, and an organic EL element D.

The switch element T1 is a transistor that controls writing, to the capacitor C, of a signal voltage Vin applied to a data line DL. A write enable signal comes from a scanning line driver (driver IC block 13) over a scanning line WL.

The capacitor C is a storage element that retains the signal voltage Vin of each of the pixels for the duration of a frame. Even if the writing of the signal voltage Vin is performed in a line sequential manner, using the capacitor C favorably realizes a light emission similarly to the case of writing in a plane sequential manner.

The current drive element T2 is a transistor that supplies, to the organic EL element D, a drive current corresponding to the signal voltage Vin retained by the capacitor C. The drive current herein is defined in value by a voltage Vgs that is to be applied between a gate and a source of the current drive element T2.

The duty control element T3 is a transistor that controls a light-on time ratio, i.e. a duty, in a frame of the organic EL element D. The duty control element T3 is connected in series to the organic EL element D, and performs ON/OFF control over the supply of a drive current to the organic EL element D, i.e. controls whether to make or stop a supply to the organic EL element D.

Note that a control signal of the duty control element T3 comes from a duty line control driver (driver IC block 13) over a duty control line DTL.

Figures 3A, 3B, 3C:
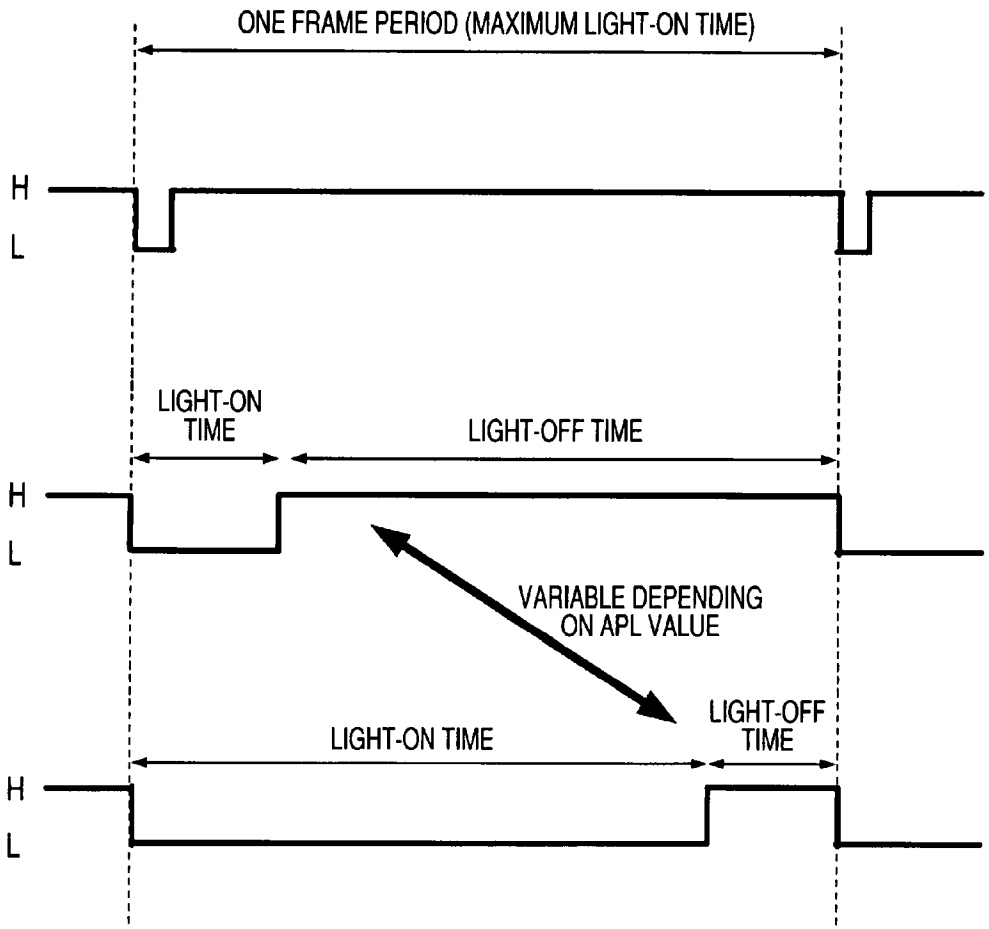
FIGS. 3A to 3C are diagrams for illustrating waveforms of a duty control signal.

FIGS. 3A to 3C show the relationship between the signal waveform of a duty control signal and the states of the organic EL element D, i.e. the states of light-on and light-off.

FIG. 3A shows a vertical synchronizing signal of a frame period, FIG. 3B shows the waveform of a duty control signal with a short light-on time, and FIG. 3C shows the waveform of a duty control signal with a long light-on time.

In this embodiment, the duty control element T3 is a P-channel FET (Field-Effect Transistor), and thus a L-level period of the duty control signal denotes the light-on time, and an H-level period denotes the light-off time.

Note that the intensity of the screen of the organic EL panel 11 is proportional to the length of the light-on time. Accordingly, a control application to make variable the length of light-on time is considered the same as a control application to make variable the physical peak intensity of a display screen.

Figure 4:
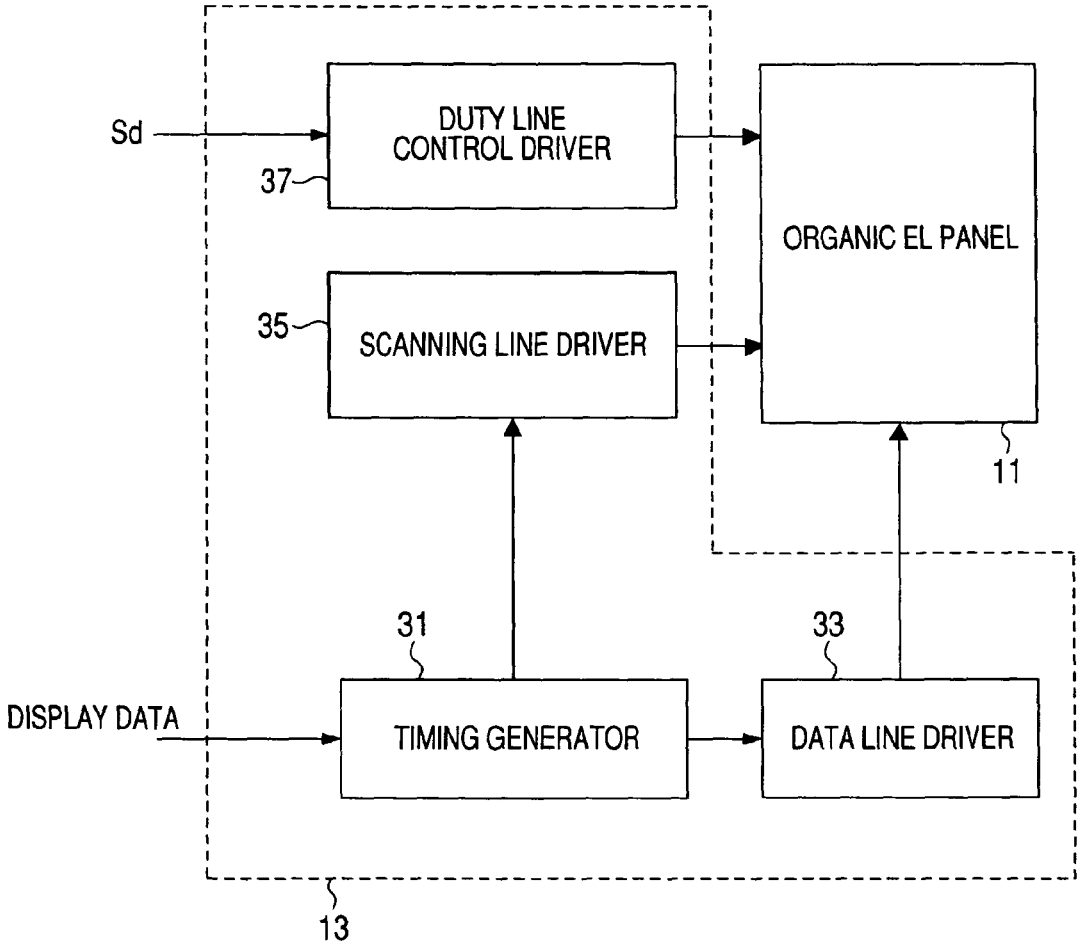
FIG. 4 is a diagram showing an exemplary internal configuration of an organic EL panel module.

FIG. 4 shows the function configuration of the driver IC block 13.

The driver IC block 13 is configured to include a timing generator 31, a data line driver 33, a scanning line driver 35, and a duty line control driver 37.

Among these components, the timing generator 31 is a circuit for generating a timing pulse for use in drive the driving.

The data line driver 33 goes through a process of applying the video signal Vin of each of the pixels on the scanning line that is a writing target. Herein, the video signals Vin are applied to the data line DL at a timing synchronous with a horizontal synchronizing signal. The scanning line driver 35 goes through a process of applying a write enable signal on a scanning line basis at a timing synchronous with a horizontal synchronizing signal.

The duty line control driver 37 goes through a process of applying a duty control signal Sd to a duty control signal line DTL. The duty control signal Sd here is the one provided by the peak intensity level control section 5, and it is increased in voltage up to a level suited for driving of the organic EL panel 11.

The peak intensity level control section 5 is a processing device that controls the driving condition of the organic EL panel module 3 in such a manner that a reduction of power condition and an increase of image quality can be achieved at the same time.

In this embodiment, the peak intensity level control section 5 is configured to include a peak intensity-up setting section 21, an APL calculation section 23, a peak intensity control section 25, and a gamma change section 27.

The peak intensity-up setting section 21 is a processing device that makes the setting about intensity-up driving to be performed with respect to the peak intensity level, i.e. whether or not to perform such driving. Herein, such a setting is made using a setting control signal provided from outside, i.e. application. The setting result is forwarded to the peak intensity control section 25 and the gamma change section 27 from the peak intensity-up setting section 21.

The APL calculation section 23 is a processing device that calculates an average picture value for every frame by subjecting incoming display data to digital processing. The resulting average picture values are forwarded to the peak intensity control section 25.

The peak intensity control section 25 is a processing device that generates a duty control signal Sd of any appropriate length of light-on time. This signal generation is performed based on the setting state of the intensity-up driving with respect to the peak intensity level. When the setting is made so as not to perform the intensity-up driving with respect to the peak intensity level, the peak intensity control section 25 generates a duty control signal Sd in which the length of light-on time takes a standard value, i.e. a fixed length.

On the other hand, when the setting is so made as to perform the intensity-up driving with respect to the peak intensity level, the peak intensity control section 25 generates a duty control signal Sd with the length of light-on time in accordance with an average picture value of display data to be calculated for every frame.

The length of light-on time is assumed to be set in a memory or other device in advance for each of the average picture values. For information, the organic EL panel 11 is changed linearly in intensity with respect to the length of light-on time. Accordingly, a rate of change observed to the length of light-on time is, as it is, an intensity-up ratio of the peak intensity level.

The gamma change section 27 is a processing device that executes, in accordance with the execution state of the intensity-up driving with respect to the peak intensity level, a gamma change process with respect to incoming display data. This gamma change process is executed based on a gamma that is set in advance.

When the setting is so made as not to perform the intensity-up driving with respect to the peak intensity level, for example, the gamma change section 27 forwards, as it is, incoming display data to the organic EL panel module 3. The gamma change value in this case is "1".

On the other hand, when the setting is made so as to perform the intensity-up driving with respect to the peak intensity level, the gamma change section 27 goes through the gamma change process with respect to the display data in such a manner that the power consumption can be reduced more than the amount of increase thereof as a result of the intensity-up driving with respect to the peak intensity level.

In this embodiment, the gamma change value is set to a fixed value of 1 or larger. The gamma change value herein is set in advance based on a value assumed for an average increase-up ratio of the peak intensity level. Generally, the larger the assumed amount of increase of the power consumption, the larger the gamma change value will be. The specific manner of setting will be described later.

A-2. Determination of Gamma Change Value

As described above, the peak intensity level control section 5 in this embodiment applies, characteristically, gamma change to incoming display data in such a manner that the power consumption can be reduced more than the amount of increase thereof as a result of the intensity-up driving with respect to the peak intensity level.

Figure 5:
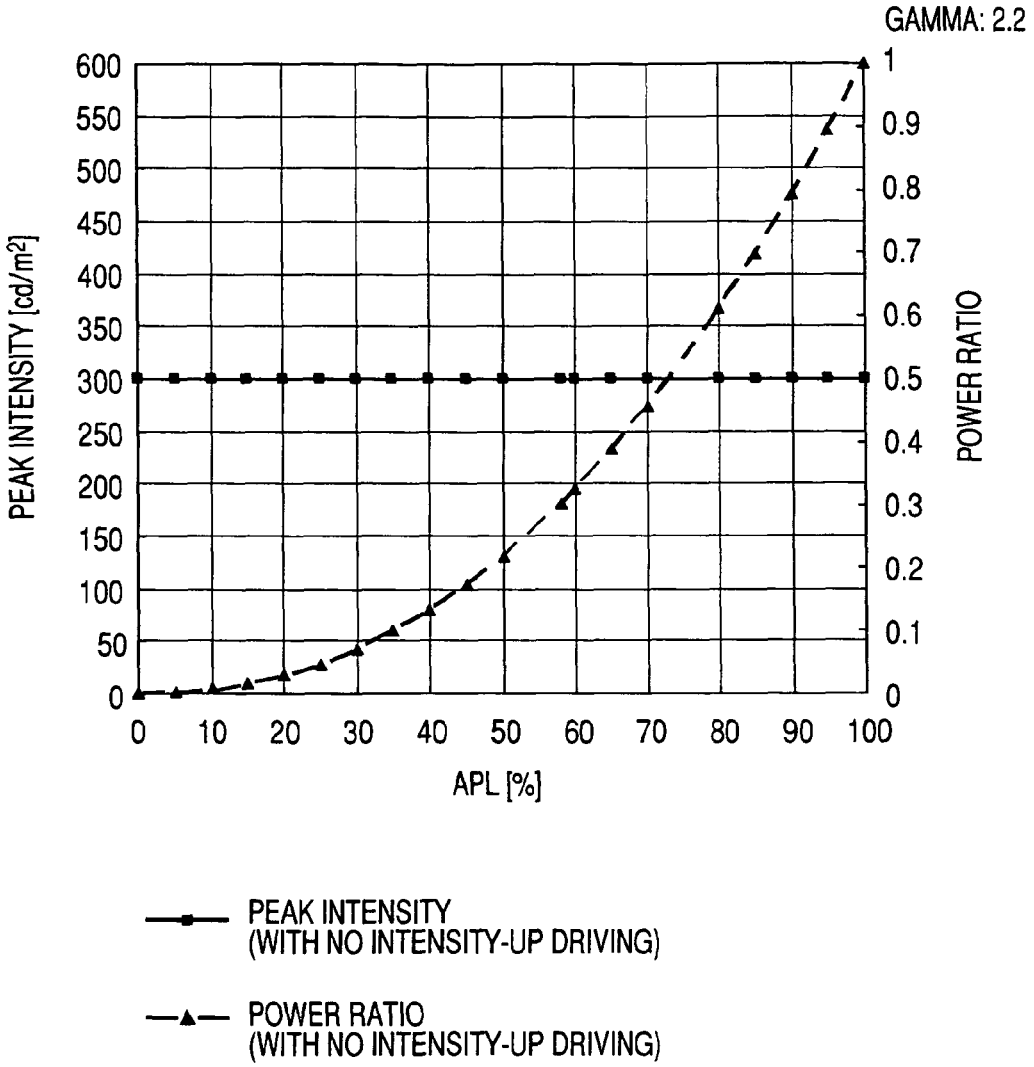
FIG. 5 is a diagram showing the relationship between an average picture value and a level of power consumption when no intensity-up process is executed with respect to a peak intensity level.

Described below is how to determine a gamma change value.

a. Relationship between Increase-up Ratio of Peak Intensity Level and Power Consumption FIG. 5 shows the relationship between an average picture value and a level of power consumption when no intensity-up driving is performed with respect to the peak intensity level. On the other hand, FIG. 6 shows the relationship between an average picture value and a level of power consumption when intensity-up driving is performed with respect to the peak intensity level.

Figure 6:
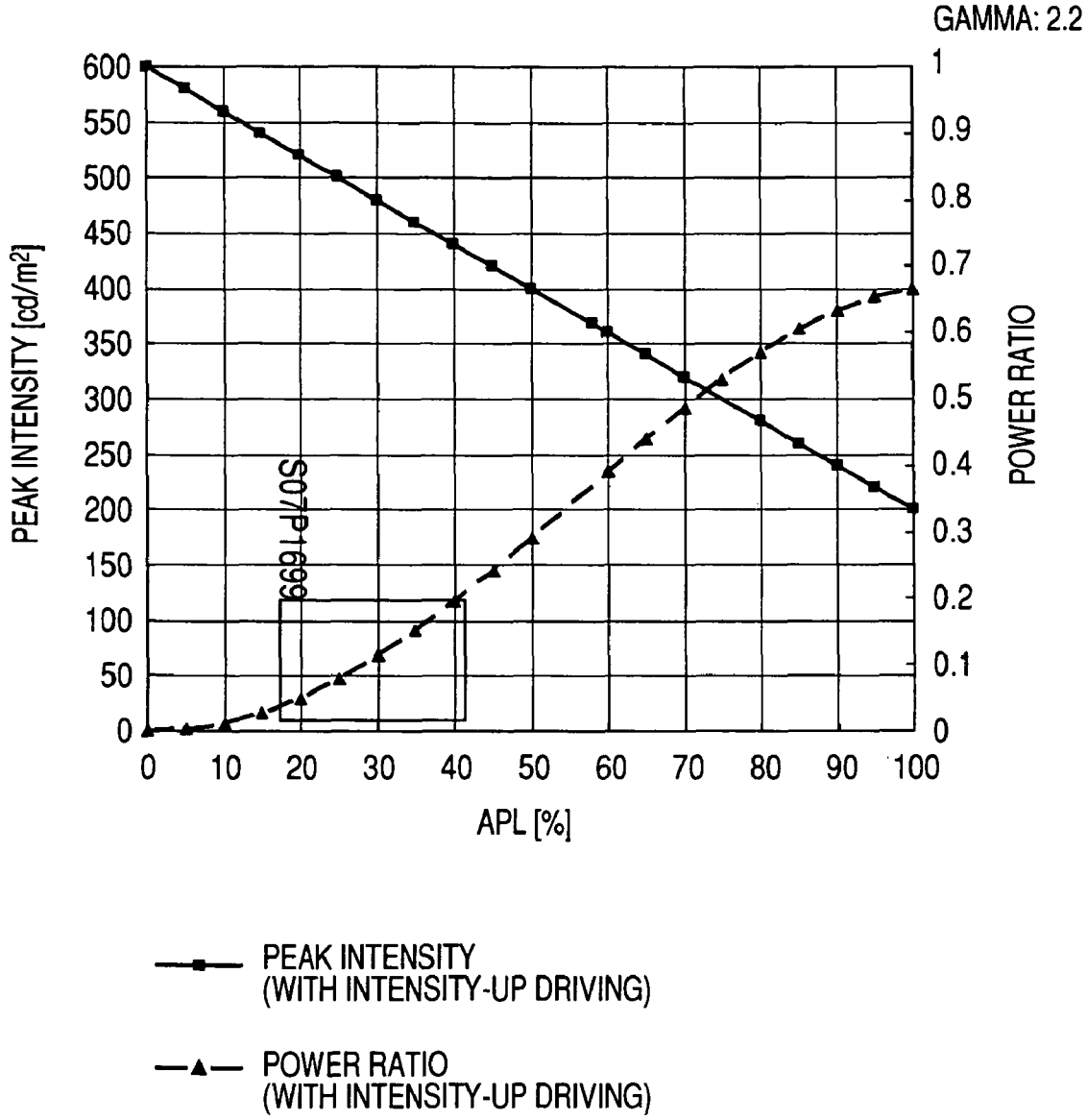
FIG. 6 is a diagram showing the relationship between an average picture value and a level of power consumption when an intensity-up process is executed with respect to the peak intensity level.

In both diagrams of FIGS. 5 and 6, the scale on the vertical axis on the left side indicates the peak intensity level, and the scale on the vertical axis on the right side indicates the power ratio. The power ratio is a value when the power to be consumed is "1" with the average picture value being with 100% intensity, i.e. every pixel is with 100% intensity.

When the intensity-up driving is not performed with respect to the peak intensity level (FIG. 5), the peak intensity level is 300 [cd/m$^2$] for every average picture value. On the other hand, when the intensity-up driving is performed with respect to the peak intensity level (FIG. 6), the peak intensity level is set to be larger with the smaller average picture value of incoming display data and to be smaller with the larger average picture value thereof.

When a display image is almost solid white, the peak intensity is reduced down to 200 [cd/m$^2$] or closer. The power ratio at this time is about 0.66.

On the other hand, when a display image is almost solid black, the peak intensity is increased up to 600 [cd/m$^2$] or closer.

Note that, with the characteristics of intensity-up driving with respect to the peak intensity level, as shown in FIG. 6, the peak intensity level shows a linear change from a range of low average picture values to a range of high average picture values. However, the change of the peak intensity level is not necessarily restricted to the linear.

The change of the peak intensity level may be curved as long as it has such characteristics that the peak intensity level is successively reduced as an average picture value comes closer to the range of high values.

The characteristics of intensity-up driving with respect to the peak intensity level of FIG. 6 are those generally used. Such intensity-up for the peak intensity level indeed enhances the appearance of a display screen but often increases the power consumption. Such characteristics are described by referring to FIG. 7.

Figure 7:
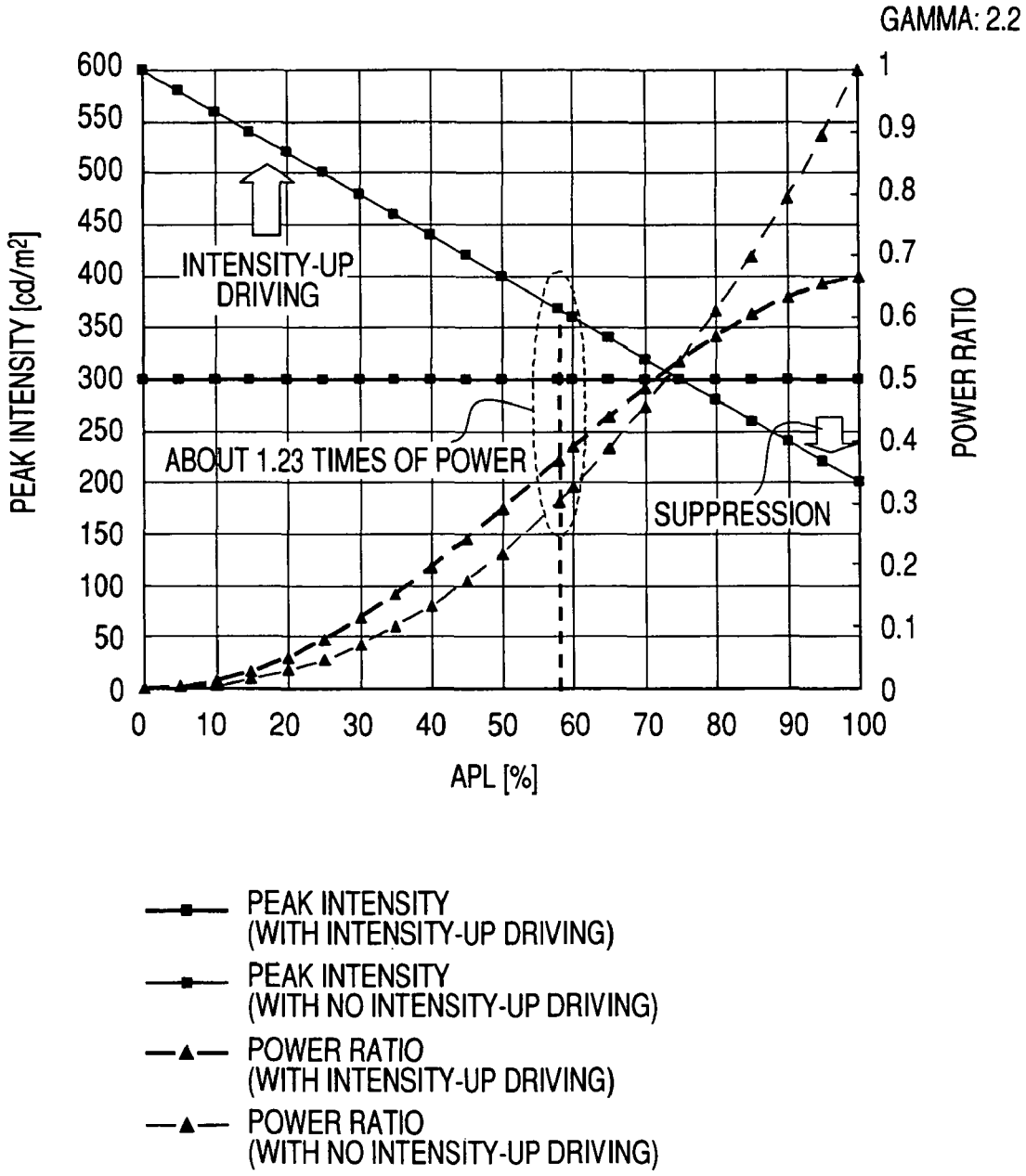
FIG. 7 is a diagram for illustrating an increase of power consumption as a result of intensity-up driving performed with respect to the peak intensity level.

In FIG. 7, FIGS. 5 and 6 are overlaid one on the other for use of comparison in terms of level of power consumption with or without intensity-up driving performed to the peak intensity level.

It is generally known that the organic EL panel 11 has the intensity level of 30% on average. For the display of a general television broadcast program, the average intensity level is considered as being about 30%, and most of the display contents found in this world are considered as being with the intensity level of about 30%.

Assuming that the organic EL panel 11 has the gamma of 2.2, i.e. almost a general value, the average picture value of about 58% is considered as being an average level for any general display contents.

In FIG. 7, a portion in the vicinity of a point where the average picture value is about 58% is enclosed by a dotted line.

As such, under general use, the power to be consumed with continuous display with the average picture value being about 58% is assumed as being the average.

Comparing the power to be consumed as such between the cases with and without intensity-up driving with respect to the peak intensity level tells the amount of reduction expected for power consumption by gamma change.

There is generally a proportional relationship between the intensity of the organic EL panel 11 and the current. It is thus considered that any increase of intensity as a result of intensity-up driving causes an increase of power consumption.

In FIG. 7, the peak intensity level corresponding to the average picture value of 58% is increased from 300 [cd/m$^2$] to 368 [cd/m$^2$].

The intensity-up ratio in this case is about 23%. This tells that the power consumption to be increased as a result of intensity-up driving with respect to the peak intensity level is about 23%.

Figure 8:
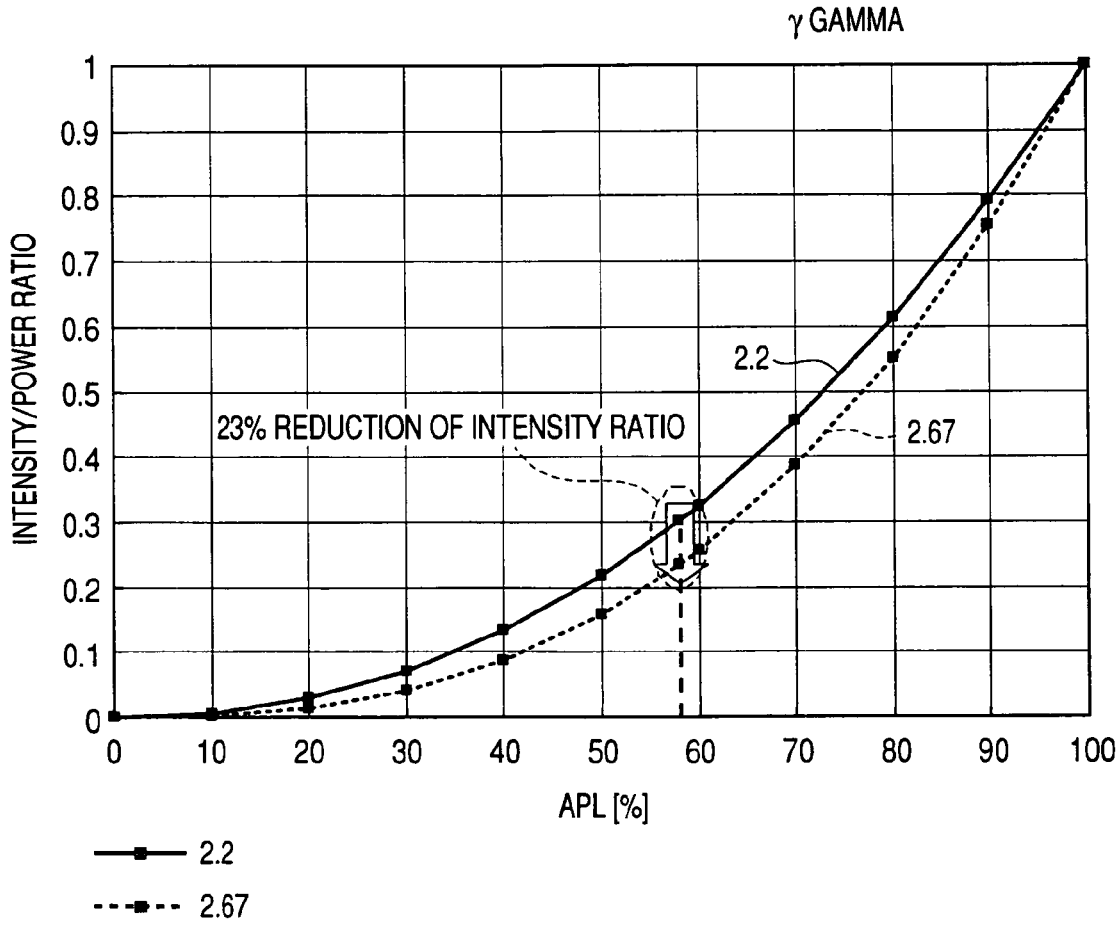
FIG. 8 is a diagram for illustrating an exemplary setting of gamma, reducing the increased amount of power consumption as a result of the intensity-up process executed with respect to the peak intensity level.

Note that, surely, if a change of the peak intensity level is small at the time of intensity-up driving, the increase of the power consumption also will be small.

b. Requirements for Gamma Change Value Needed to Cancel Out Amount of Increase in Power Consumption FIG. 8 shows an exemplary setting of the gamma needed to reduce the amount of increase of power consumption as a result of intensity-up driving performed with respect to the peak intensity level. The gamma has the effects of reducing only the intensity in a halftone area of the incoming display data, i.e. making the gamma curve steeply curved.

As described above, a gamma factor providing the intensity characteristics, i.e. the gamma, with respect to the picture value of the organic EL panel 11 is generally 2.2. In this case, if the gamma factor can be set to a value that can make the gamma curve steeply curved more than with a gamma of 2.2, the halftone area of the incoming display data can be reduced in intensity, i.e., the power consumption can be reduced.

As such, the value of a gamma factor that can cancel off the amount of increase in power consumption as a result of the intensity-up driving with respect to the peak intensity level is now considered.

The inventors of the invention herein pay attention to an average intensity level, i.e. an average picture value, of the organic EL panel 11. This is because even if the actual display details vary, the average intensity level is considered as being the same as the average intensity level, i.e. an average picture value, of the organic EL panel 11.

In this embodiment, at the point where the average picture value is 58%, the minimum requirements are a gamma factor that can reduce 23% of the intensity corresponding to the gamma of 2.2. In this embodiment, the gamma factor is required to be 2.67 or larger.

c. Setting of Gamma Change Value and Gamma Change Process

Figure 9:
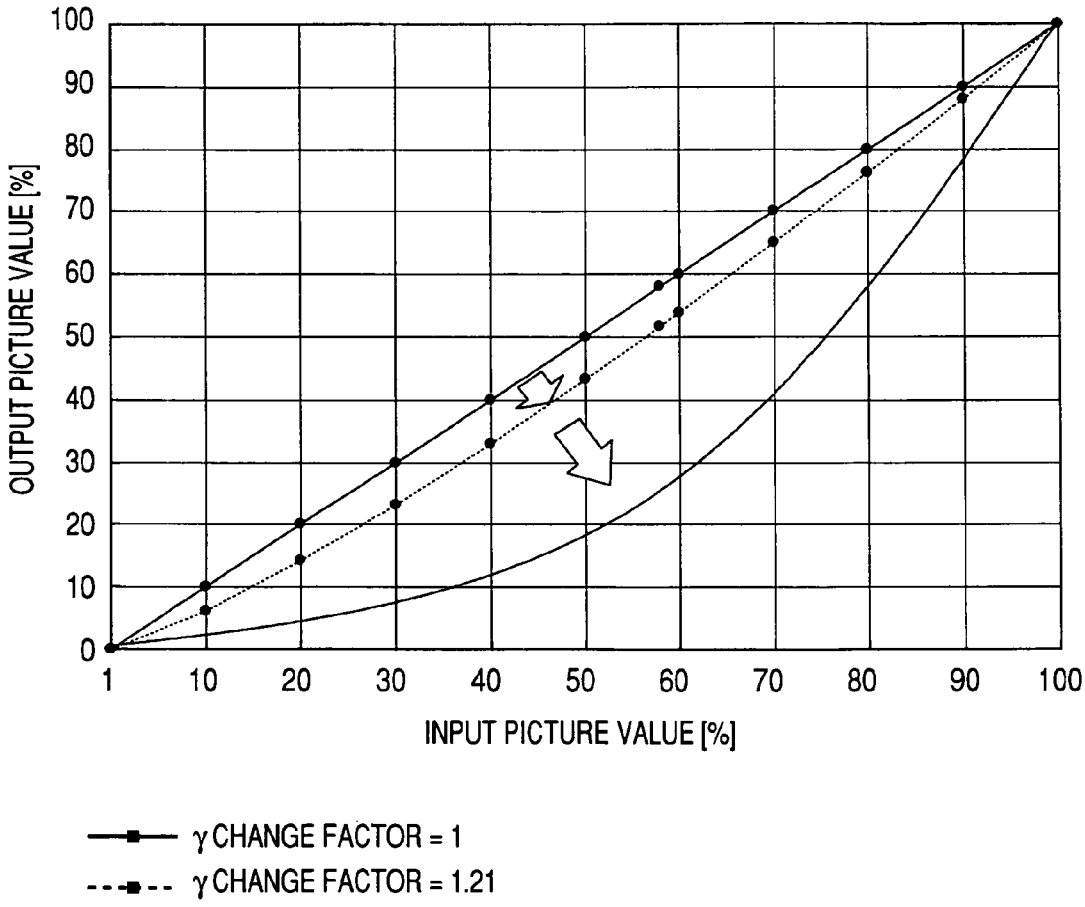
FIG. 9 is a diagram for illustrating the gamma for use in a gamma change process.

FIG. 9 shows the details of a gamma change process to be executed by the gamma conversion section 27. That is, FIG. 9 shows how to perform a gamma change with respect to display data for use in changing the intensity characteristics, i.e. the gamma, from 2.2, which is an original value, to 2.67 for the picture value.

As described above, the organic EL panel 11 is originally provided with the gamma of 2.2 with respect to the display picture value. As such, the gamma change performed by the gamma change section 27 realizes a gamma of 2.67 in addition to the gamma of 2.2

When the intensity-up driving is not performed with respect to the peak intensity level, the gamma change section 27 uses a gamma change value of 1, i.e. an input picture value shares the same value as an output picture value.

On the other hand, when the intensity-up driving is performed with respect to the peak intensity level, the gamma change section 27 uses a gamma change value of 1.21, which is calculated based on 2.67/2.2.

If the gamma change value is increased so as to be larger than 1.21 for the organic EL panel 11, i.e. if the amount of reduction is increased with respect to any average power consumption, the power consumption can be smaller than the case of not performing intensity-up driving with respect to the peak intensity level.

Figure 10:
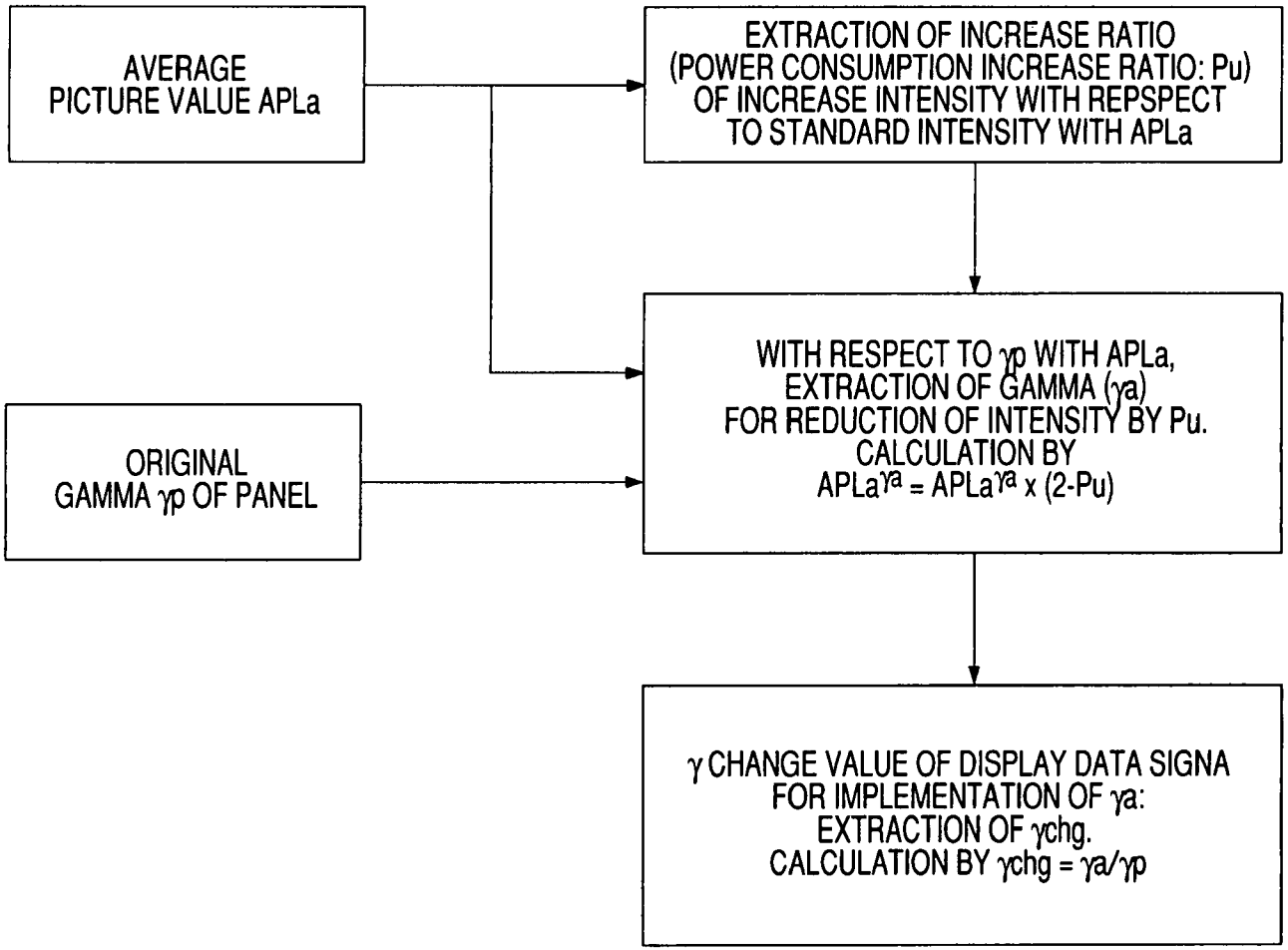
FIG. 10 is a diagram showing the process flow until a gamma change value is set.

FIG. 10 schematically shows the flow until such a gamma change value is set. Note that, in FIG. 10, the average intensity level, i.e. the average picture value, assumed for the organic EL panel 11 is APLa, and the increase ratio of power consumption at the time of intensity-up driving with respect to the peak intensity level is Pu. The values of APLa and Pu are both assumed as being normalized, i.e. the ratios with respect to 1.

Moreover, the original gamma factor of the organic EL panel 11 is γp, and the gamma factor needed to reduce the power consumption more than the amount of increase thereof as a result of intensity-up driving with respect to the peak intensity level is γa. The gamma change value needed to realize the gamma factor of γa is γchg.

First of all, for APLa, a ratio of an increase of the peak intensity level with respect to a standard intensity after intensity-up driving, i.e. intensity with no intensity-up driving, is calculated. The thus calculated ratio of increase is then extracted. In this embodiment, the ratio of an increase of the intensity as a result of intensity-up driving is the same in value as the ratio of an increase Pu of power consumption.

For extraction of the ratio of increase Pu, information about APLa being an estimated value for the organic EL panel 11 is used.

Next, for γp at the time of APLa, a gamma γa is calculated for use is reducing the power, i.e. the intensity, by the amount of Pu.

The equation at this time is calculated in ratio, and is derived by the next relational expression.

$$APLa^{\gamma a}=APLa^{\gamma p}\times(2-Pu)$$

For realizing the lastly-calculated γa, a gamma change value, i.e. γchg, is calculated for a display data signal.

The equation is as below.

$$\gamma chg=\gamma a/\gamma p$$

In the specific example described above, by substitution of γa=2.67 and γp=2.2 into this equation, a gamma change value of 1.21 is derived.

The gamma change section 27 subjects incoming display data to gamma change based on input/output characteristics, i.e. gamma, corresponding to the gamma change value of 1.21 set as such. The resulting display data is then forwarded to the organic EL panel module 3.

A-3. Effects of Embodiment

As described above, with the organic EL display device of this embodiment, the combination of the intensity-up driving with respect to the peak intensity level and the gamma change process by the gamma change section 27, i.e. the gamma change value of 1.21, enables the suppression of an increase of power consumption without fail while realizing a higher image quality.

That is, intensity-up driving with respect to the peak intensity level while the increase of power consumption is being suppressed is realized. In other words, the technology of controlling the peak intensity level while achieving the suppression of power consumption and the enhancement of appearance of a display screen is realized.

With the technology described in this embodiment, the gamma change value can be set to any arbitrary value that is 1 or larger.

As such, it becomes possible not only to simply cancel out the amount of increase of power consumption as a result of intensity-up driving performed with respect to the peak intensity level but also to reduce the power consumption more than the amount of increase as a result thereof. That is, the power consumption can be reduced more than in a case with no intensity-up driving to the peak intensity level.

Note that, in this embodiment, any general use is assumed for the organic EL panel 11, i.e. an average picture value is assumed for incoming display data, and any set gamma change value is applied to every incoming display data so that there is no need to go through a process of calculating a gamma change value for every frame. As such, the signal processing and system configuration both can be simplified.

Moreover, because the gamma is fixed, even if incoming display data shows a quick and obvious brightness change, the image quality can be expected to be stable with the gamma change value being fixed.

As such, the reduction of power consumption can be realized with a satisfactory image quality kept as such, and if with a battery-powered device, its operation time can be increased to a further extent. What is more, if with a device of receiving a power supply from a commercial power line source (AC (Alternating Current) outlet), the electricity bill can be reduced.

B. Another Embodiment

B-1. Switching Process 1 of Gamma Change Value

In the embodiment described above, the case in which any general use of the organic EL panel 11 is assumed, i.e. a long-term average picture value is assumed for incoming display data, and a gamma change value is set based thereon for use with every incoming display data is described.

Alternatively, the gamma change process may be executed only with a range of picture values of increasing the power consumption as a result of intensity-up driving with respect to the peak intensity level, and the gamma change process may be stopped for execution with a range of picture values of reducing the power consumption as a result of intensity-up driving with respect to the peak intensity level.

Figure 11:
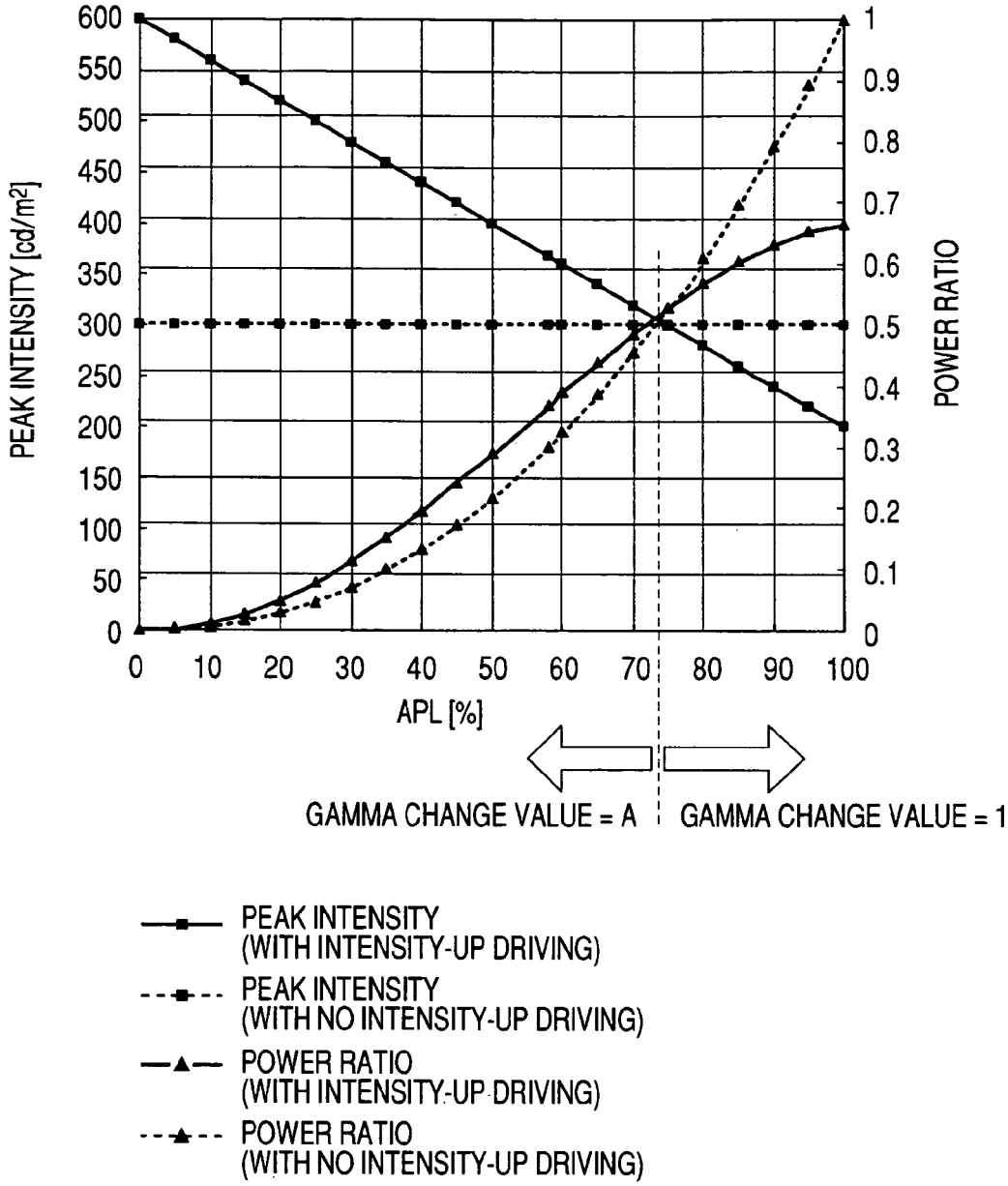
FIG. 11 is a diagram for illustrating an exemplary setting of a timing point of changing the gamma change value to be binary.

FIG. 11 shows an exemplary setting of a timing point with which binary switching of a gamma change value is realized. In FIG. 11, a timing point is set at an average picture value where the intensity value of performing the intensity-up driving with respect to the peak intensity level intersects with the intensity value of not performing intensity-up driving with respect to the peak intensity level. In FIG. 11, the boundary of such an area is indicated by a dotted line.

As shown in FIG. 11, in an area where an average picture value is larger than the value at a timing point, the power consumption is reduced by the intensity-up driving with respect to the peak intensity level. On the other hand, in an area where an average picture value is smaller than the value at a timing point, the power consumption is increased by the intensity-up driving with respect to the peak intensity level.

That is, in an area where an average picture value is larger than the value at a timing point, a solid line connecting solid-filled triangle-shaped marks is located below a dotted line connecting other solid-filled triangle-shaped marks. On the other hand, in an area where an average picture value is smaller than the value at a timing point, the solid line connecting solid-filled triangle-shaped marks is located above the dotted line connecting other solid-filled triangle-shaped marks.

As such, when incoming display data is of an average picture value smaller than the value at a timing point, using a gamma change value determined as described above (>1), the intensity-up driving with suppression of an increase of power consumption is performed.

On the other hand, when incoming display data is an average picture value larger than the value at a timing point, a gamma change process with a gamma change value of "1" is performed, and the effects of reducing the power consumption by the suppression of the peak intensity level are utilized aggressively.

As a result, with respect to any average display details provided to the organic EL panel 11, a reliable reduction of power consumption and improvement of image quality as a result of intensity-up driving with respect to the peak intensity level are realized at the same time.

Figure 12:
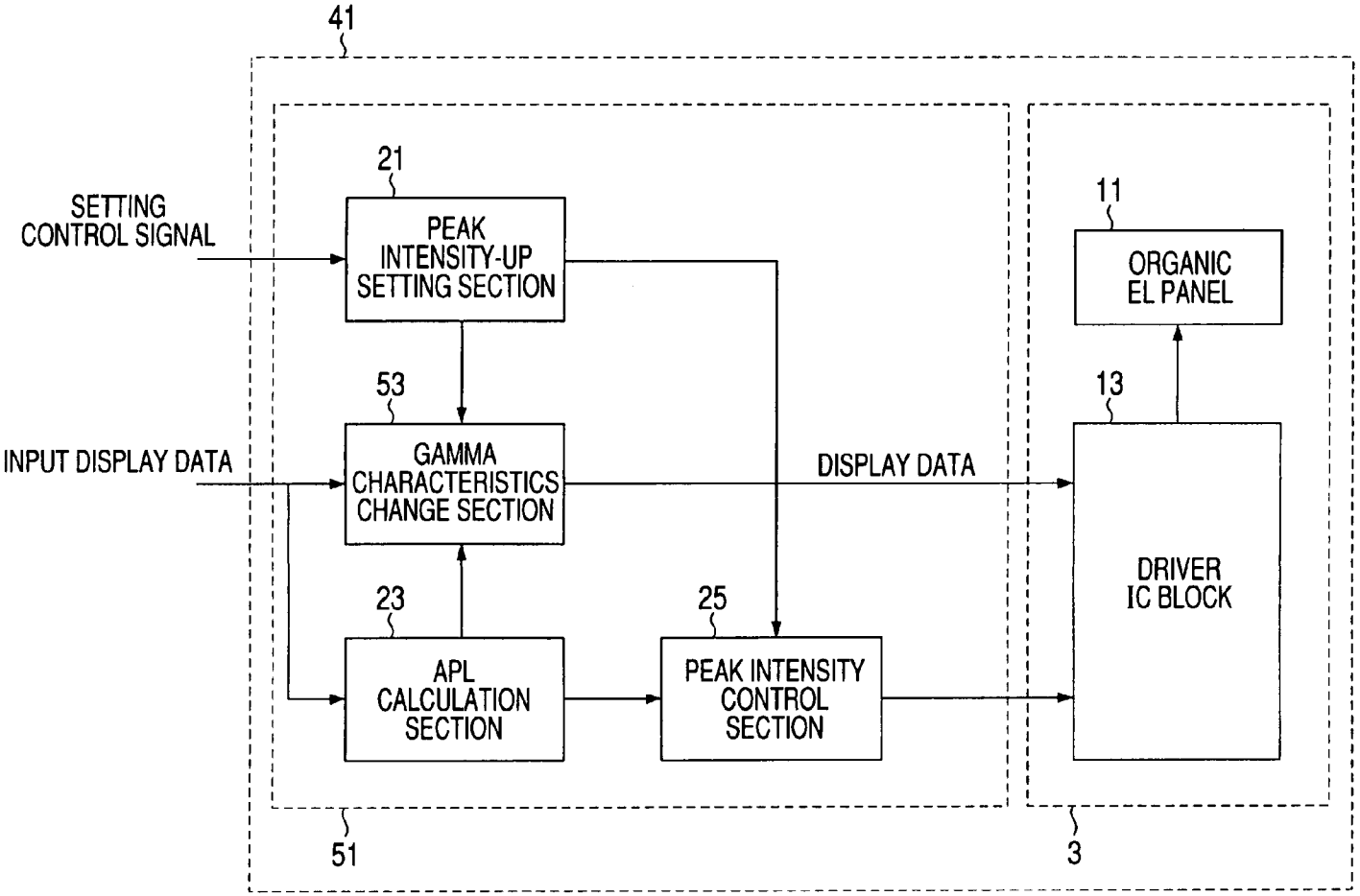
FIG. 12 is a diagram showing another exemplary function configuration of the organic EL display device.

FIG. 12 shows an exemplary configuration of an organic EL display device 41 carrying therein a gamma change section that can change a gamma change value for every range of average picture values.

Note that, in FIG. 12, any components similar to those of FIG. 1 are provided with the same reference numerals.

The differences between the configurations of FIGS. 12 and 1 are a gamma change section 53 that is provided with a function of changing a gamma change value, and an average picture value is provided for every frame. Herein, the gamma change section 53 is the one configuring a peak intensity level control section 51, and the average picture value to be provided for every frame is the one calculated by the average picture calculation section 23 for implementing a process of changing a gamma change value.

Figure 13:
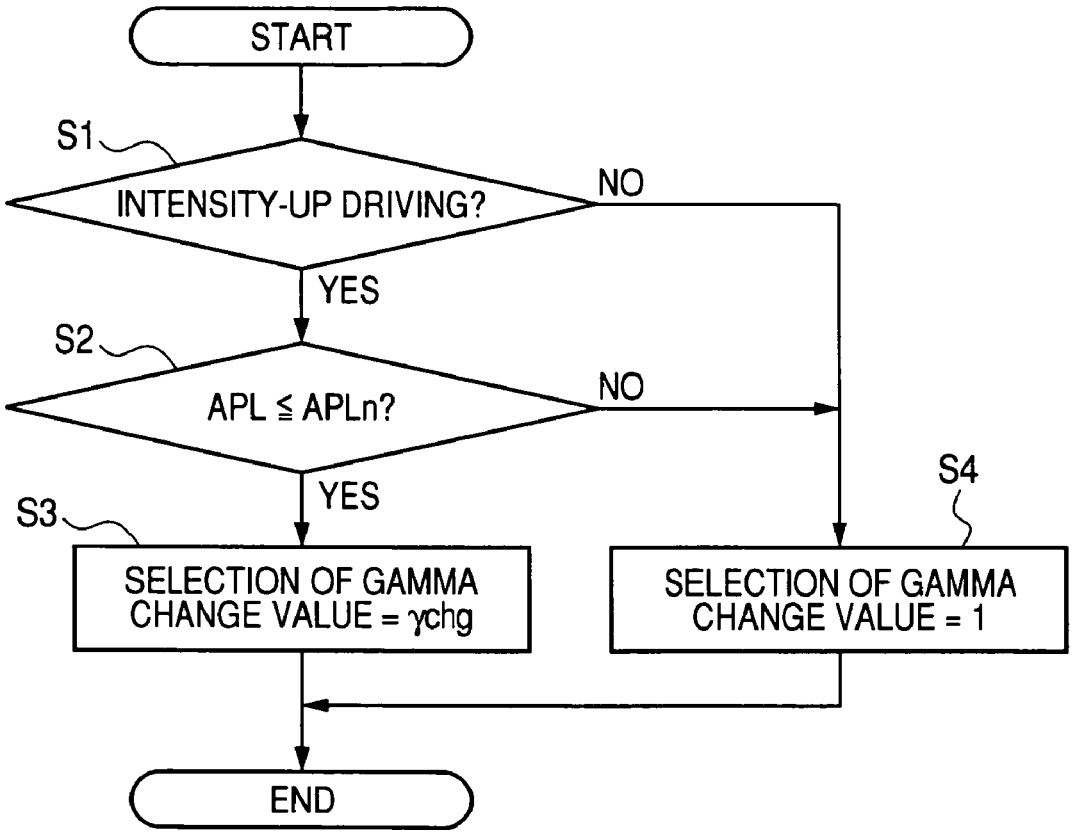
FIG. 13 is a diagram showing an exemplary control flow for execution by a gamma change section.

FIG. 13 shows the control flow to be executed by the gamma change section 53. First of all, the gamma change section 53 makes a determination whether the setting is made to perform intensity-up driving or not (S1).

When the determination result is positive, the gamma change section 53 makes a determination whether an average picture value calculated for input display data of every frame is equal to a picture value APLn or smaller (S2). Herein, the picture value APLn is the one providing a timing point.

When the determination result is also positive this time, the gamma change section 53 selects a gamma change value γchg (>1) that is previously set, and goes through a gamma change process based on the gamma change value γchg (S3).

On the other hand, when the result of the determination process S1 or S2 is negative, the gamma change section 53 selects "1" for a gamma change value, and any input picture value is forwarded to the organic EL panel module 3 as it is (S4).

As described above, with the execution of such a process, only when an average picture value is low, and only when the power consumption shows an increase as a result of the intensity-up driving with respect to the peak intensity level, the gamma change process of reducing the display intensity in a halftone area can be executed.

As a result, the power consumption as a result of intensity-up driving with respect to the peak intensity level can be reduced without fail compared with the power consumption with no intensity-up driving.

B-2. Switching Process 2 of Gamma Change Value

In the "switching process 1" above, the case of applying binary switching to a gamma change value after a timing point is described.

The concern here is that, with the display of moving images, for example, when an average picture value of incoming display data smoothly passes through a timing point, there is a possibility that any binary change of gamma may be acknowledged as a reduction of image quality.

In consideration thereof, a method of not using "1" for a gamma change value in every average picture area at the time of intensity-up driving with respect to the peak intensity level is purposed. In other words, a method of gradually changing a gamma change value between any two binary values is purposed.

When the increase ratio of the intensity as a result of intensity-up driving with respect to the peak intensity level is not that large, the amount of change observed to the gamma is also small. In this sense, the method is considered effective in making less conspicuous any reduction of image quality in a portion in the vicinity of a timing point.

Figure 14:
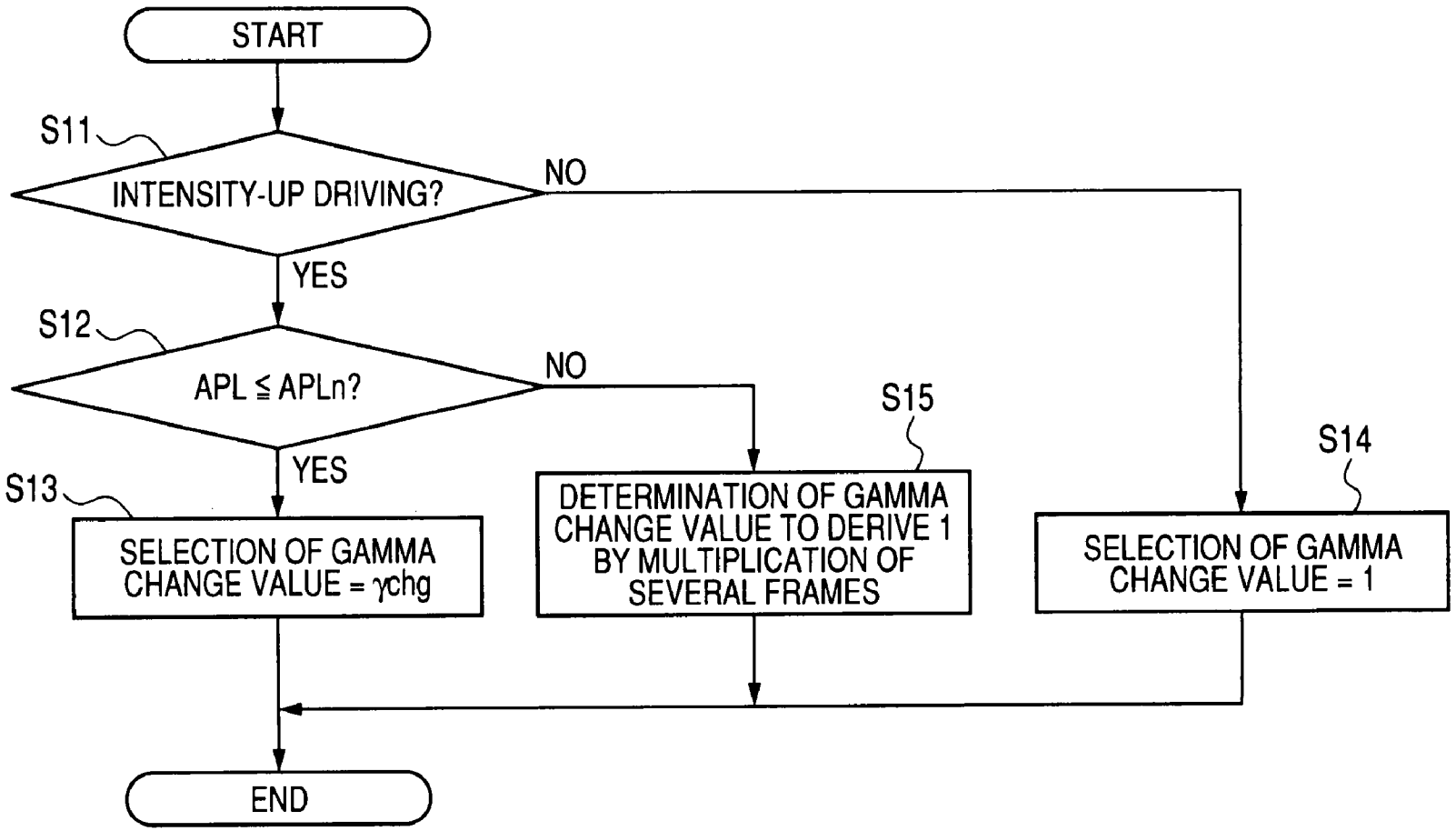
FIG. 14 is a diagram showing another exemplary control flow for execution by the gamma change section.

FIG. 14 shows an exemplary control flow of the gamma change section 53 corresponding to such a process function. Note that the organic EL display device has a similar system configuration to that of FIG. 12.

First of all, the gamma change section 53 determines whether any setting is made for execution of the intensity-up driving or not (S11).

When the determination result is positive, the gamma change section 53 determines whether an average picture value calculated for a display data signal of every frame is equal to or smaller than a picture value APLn, which provides a timing point (S12).

When the determination result is also positive this time, the gamma change section 53 selects a previously-set value γchg for use as a gamma change value, and goes through a gamma change process based on the value (S13).

On the other hand, when the result of the determination process S11 is negative, the gamma change section 53 selects "1" for use as a gamma change value, and any input picture value is output as it is (S14).

When the result of the determination process S12 is negative, the gamma change section 53 determines a gamma change value in such a manner that the gamma change value is changed to "1" with the multiplication of a few frames, and goes through a gamma change process based on the gamma change value determined as such (S15).

Figure 15:
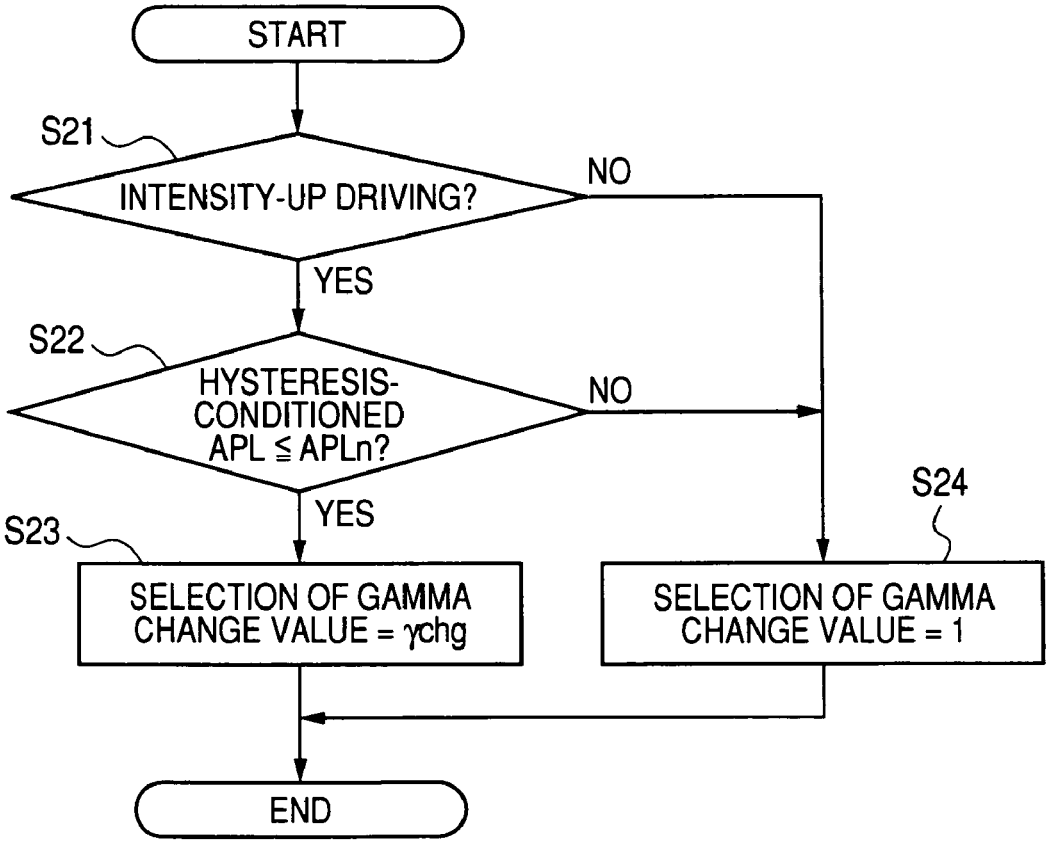
FIG. 15 is a diagram showing still another exemplary control flow for execution by the gamma change section.

Other than such a method, the process of FIG. 15 is also a possibility. With this method, the organic EL display device is assumed to have a system configuration similar to that of FIG. 12.

First of all, the gamma change section 53 determines whether any setting is made to execute the intensity-up driving or not (S21).

When the determination result is positive, the gamma change section 53 determines whether an average picture value calculated for a display data signal of every frame is equal to or smaller than a picture value APLn, which provides a timing point (S22).

Note that, in the determination process, a determination is made with filter processing including a hysteresis function, for example. That is, when the determination result is changed with respect to a picture value APLs providing a timing point, only when previously-set hysteresis requirements are satisfied, the determination result is finally allowed to be changed.

When the determination result is also positive this time, the gamma change section 53 selects a previously-set value γchg for use as a gamma change value, and goes through a gamma change process based on the value (S23). On the other hand, when the result of the determination process 21 or S22 is negative, the gamma change section 53 selects "1" for use as a gamma change value, and any input picture value is output as it is (S24).

As described above, with such a process, when an average picture value of incoming display data is changed before and after a timing point, it is possible to prevent a phenomenon of a gamma change value being changed frequently.

As a result, the reduction of image quality as a result of any change of gamma can be prevented while keeping the effects of reducing the power consumption as a result of intensity-up driving with respect to the peak intensity level compared with the power consumption without the intensity-up driving.

B-3. Setting of Gamma Change Value

In the embodiment described above, the case of setting a gamma change value γchg for use during intensity-up driving with respect to the peak intensity level with an assumption of general use of the organic EL panel 11, i.e. with an assumption of average picture value of incoming display data is described.

That is, described is the case of applying any fixed gamma.

Alternatively, the gamma, i.e. the gamma change value, may be set for every frame associated with an average picture value of incoming display data calculated for every frame.

When the amount of increase of power consumption is large as a result of intensity-up driving with respect to the peak intensity level, for example, a gamma change value may be set to be large. On the other hand, when the amount of increase of power consumption is small as a result of intensity-up driving with respect to the peak intensity level, a gamma change value may be set to a value close to 1 (>1).

If this is the case, however, a process of reading a gamma appropriate for every average picture value for execution of the gamma change process is required to be executed for every frame.

B-4. Other Methods of Calculating Average Picture Value

In the embodiment described above, the case of calculating an average picture value of incoming display data for every frame is described.

Alternatively, an average picture value may be calculated at regular or irregular time intervals for any arbitrary frame.

Still alternatively, an average picture value may be calculated as an average value of incoming display data input during a fixed length of time, i.e. a period of a few frames.

With such calculation methods, the processing load required for the system can be reduced.

B-5. Other Methods of Controlling Peak Intensity Level

In the embodiment described above, the case of controlling the peak intensity level so as to be variable by a duty control signal, which controls a light-on time ratio during a frame period is described.

Alternatively, the peak intensity level of an organic EL panel can be controlled by other methods.

With a possible technique, the light-on time during a frame may be fixed in value, and the dynamic range of a voltage value for application to a data line DL may be controlled so as to be variable so that the peak intensity level is controlled.

Note that the characteristics of intensity change show a change with respect to a gamma reference voltage along the gamma of the organic EL panel 11. Accordingly, in this case, the intensity-up ratio with respect to the peak intensity level is controlled based on the gamma reference voltage as a result of change along the gamma.

Figure 16:
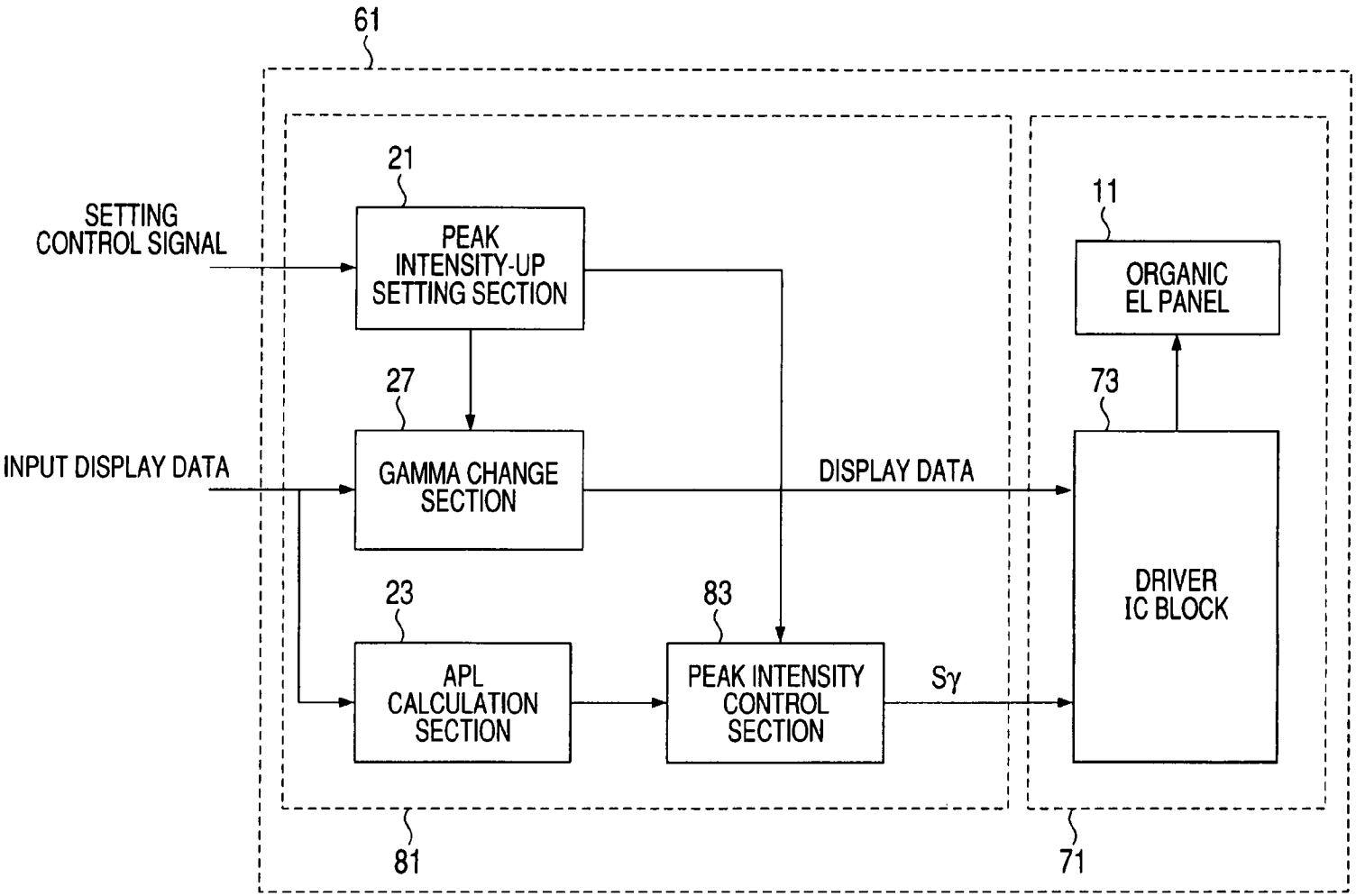
FIG. 16 is a diagram showing still another exemplary function configuration of the organic EL display device.

FIG. 16 shows the function configuration of an organic EL display device 61 with such a control method applied. Note that, in FIG. 16, any components similar to those of FIG. 1 are under the same reference numerals. The organic EL display device 61 is surely applicable to the system configurations of other embodiments.

The organic EL display device 61 is configured to include an organic EL panel module 71 and a peak intensity level control section 81.

Note that, the function blocks, except a peak intensity control section 83 configuring the peak intensity level control section 81, share the same configuration as those of the first embodiment.

The peak intensity control section 83 is a processing device that increases or decreases the peak intensity level in accordance with an average picture value. Such increase or decrease of the peak intensity level is performed through control of a gamma reference voltage of the data line driver 33. Herein, even if a gamma reference voltage is controlled linearly, the intensity of light emission is not changed so as to be linear.

As such, the peak intensity control section 83 outputs a gamma reference voltage control signal Sγ for control of the peak intensity level. The gamma reference voltage control signal Sγ is the one set in consideration of the gamma of the organic EL panel 11. Alternatively, the gamma reference voltage control signal Sγ may be so configured as to indicate only the peak intensity level or the amount of change that is a control target, and the actual reference voltage may be generated on the side of a driver IC block 73.

The organic EL panel module 71 is configured to include the organic EL panel 11 and the driver IC block 73.

The driver IC block 73 shares the same circuit configuration as that of FIG. 4 except that a gamma reference voltage generator is included. The gamma reference voltage generator serves to generate, based on the gamma reference voltage control signal Sγ, a gamma reference voltage to be applied to a digital/analog conversion circuit, which is located at the output stage of the data line driver 33.

Figure 17:
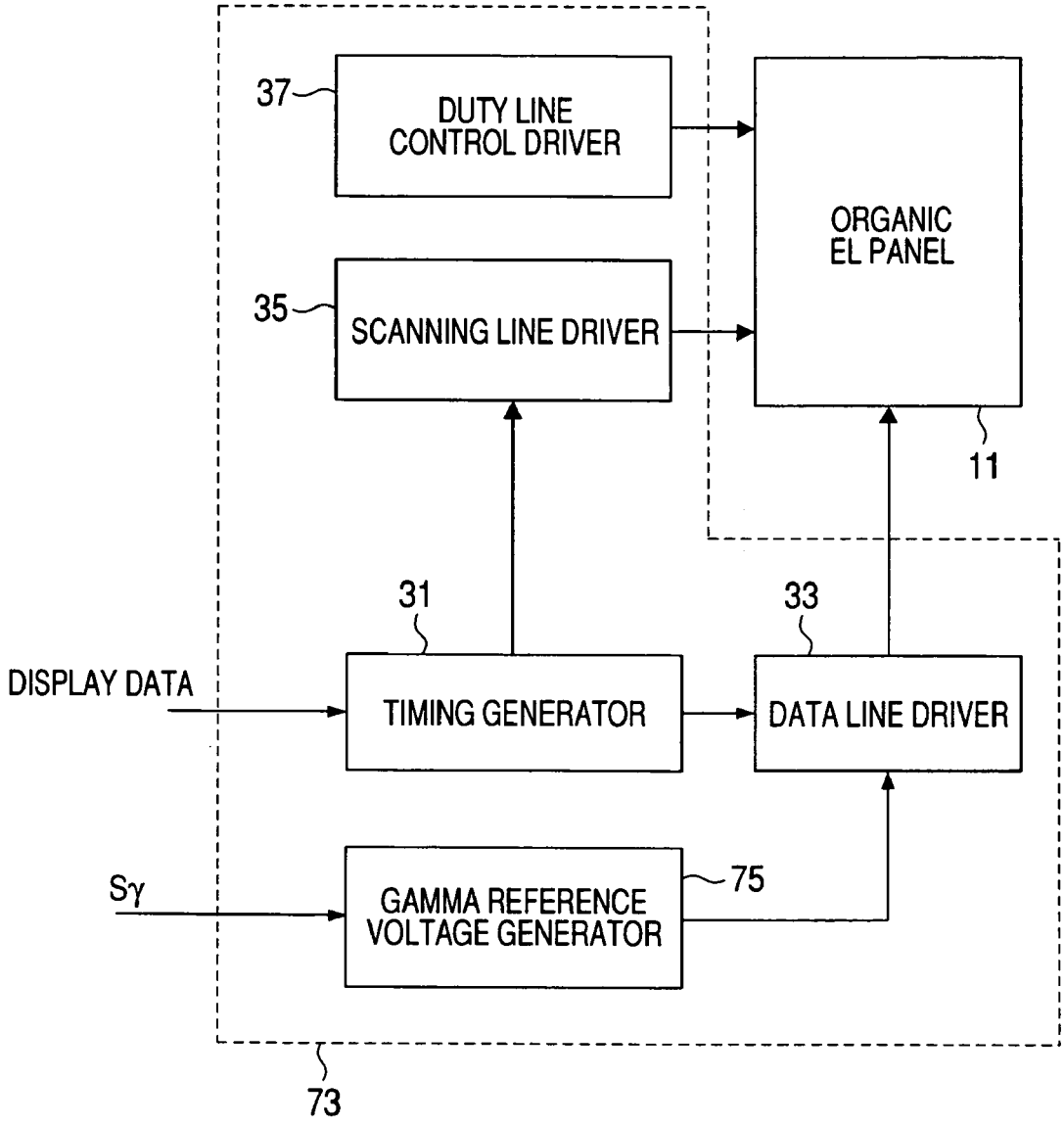
FIG. 17 is a diagram showing an exemplary internal configuration of an organic EL panel module.
Figure 18:
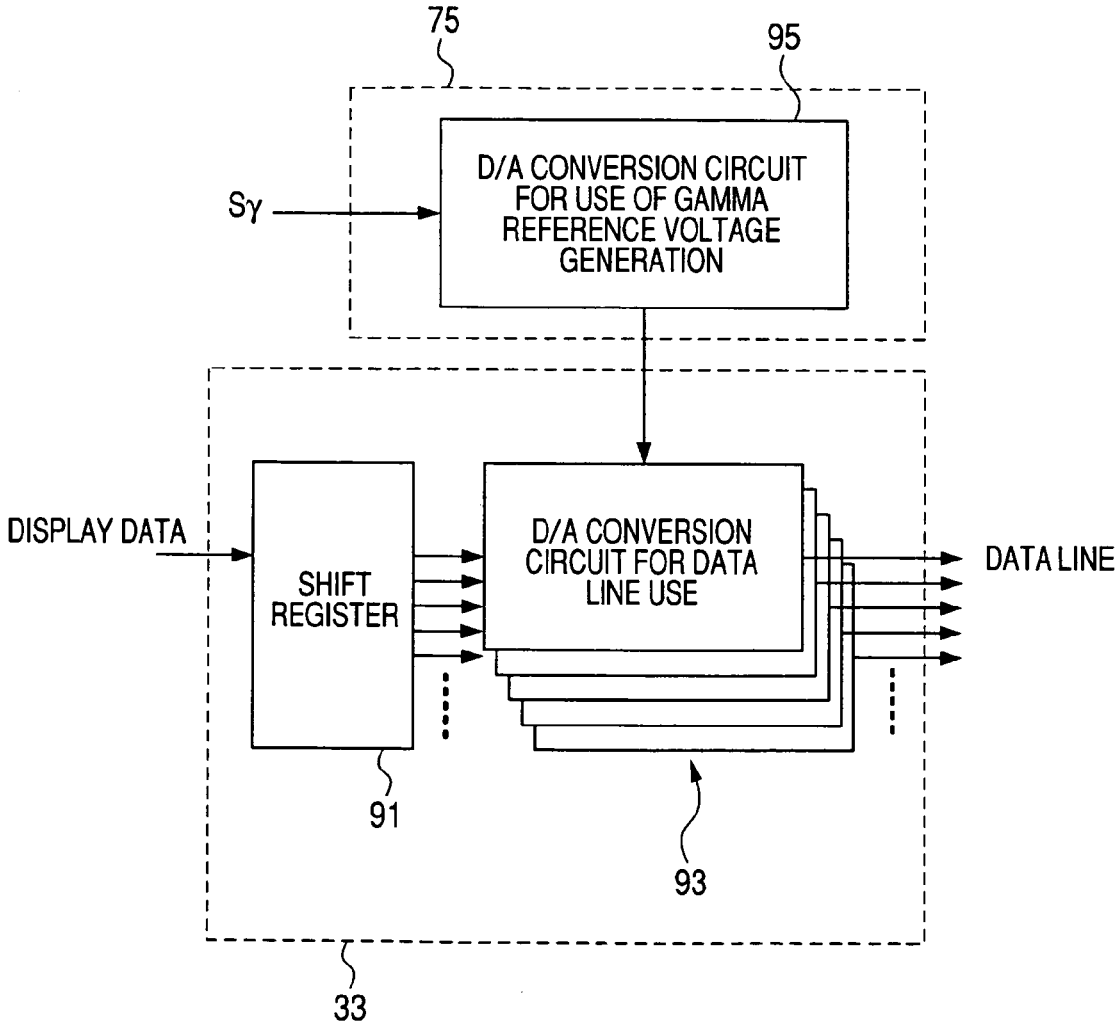
FIG. 18 is a diagram for illustrating the connection relationship between a gamma reference voltage generator and a data line driver.

FIG. 17 shows an exemplary internal configuration of the driver IC block 73, and FIG. 18 shows the connection relationship between a gamma reference voltage generator 75 and the data line driver 33. Alternatively, the gamma reference voltage generator 75 can be disposed outside of the driver IC block 73.

As shown in FIG. 18, the data line driver 33 is configured to include a shift register 91 and a D/A (Digital/Analog) conversion circuit 93. The shift register 91 serves to distribute, display data that is input in series in the placement order of pixels to any corresponding data lines, and the D/A conversion circuit 93 is for use by the data lines. The output destinations of the D/A conversion circuit 93 are the data lines.

The D/A conversion circuit 93 for use by the data lines is provided with a gamma reference voltage generated by a D/A conversion circuit 95 provided in the gamma reference voltage generator 75 for generation of a gamma reference voltage. This gamma reference voltage is used to define the dynamic range of an analog voltage coming from the D/A conversion circuit 93 for use by the data lines.

Surely, with the larger dynamic range, the driving current flowing into the organic El elements D takes a larger maximum value, thereby enabling making the organic EL elements D emit lights with a higher intensity.

Also, with such a control method, the effects similar to those in the embodiments can be achieved.

B-6. Pixel Configuration

In the embodiments described above, the pixel configuration of FIG. 2 is exemplified.

Figure 19:
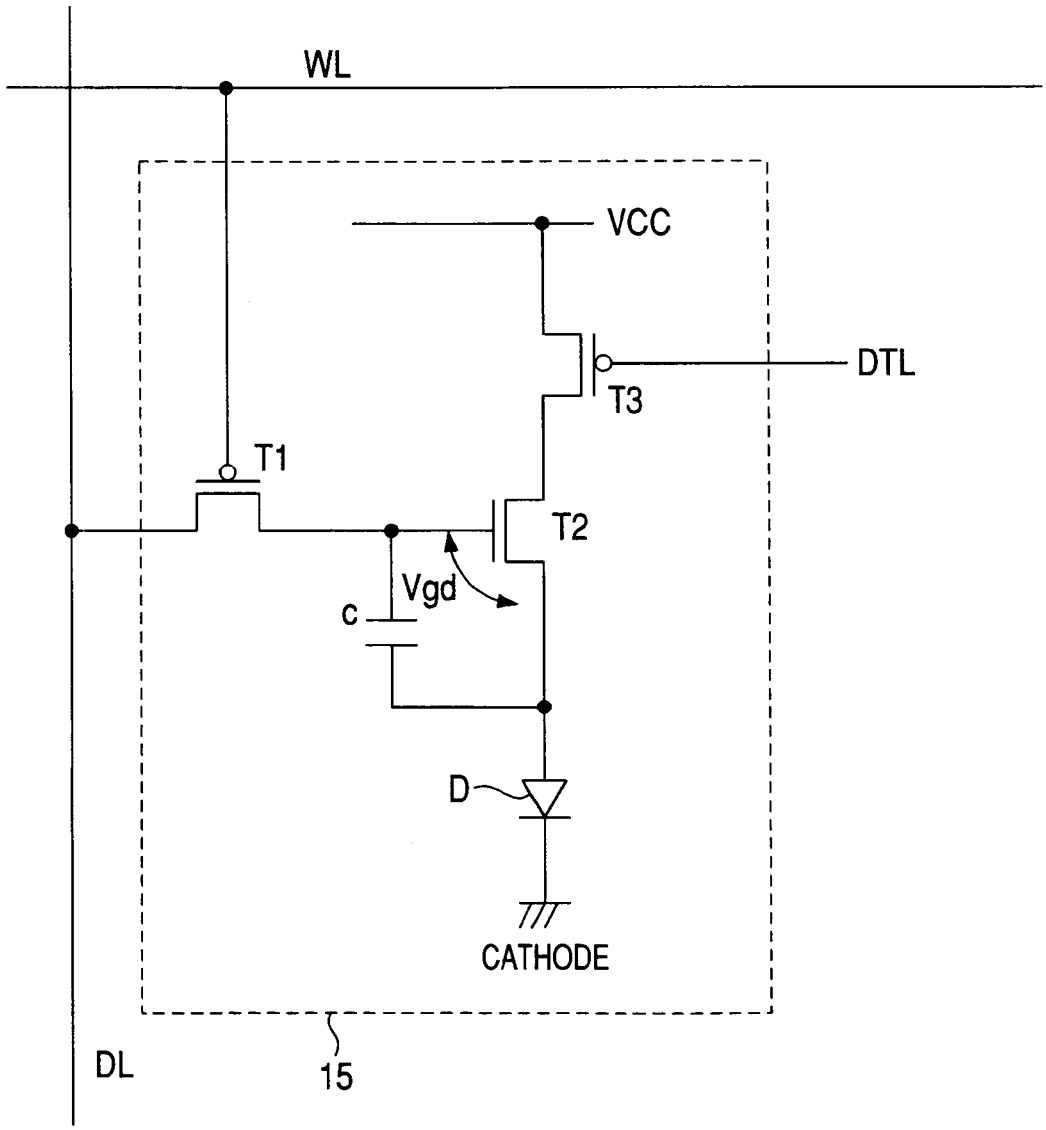
FIG. 19 is a diagram showing another pixel configuration.

The pixel configuration is surely not restricted thereto, and as shown in FIG. 19, for example, a current drive element T2 may be of an N-channel FET, and the capacitor C may be connected between a gate electrode and a drain electrode of the current drive element T2.

B-7. Exemplary Products a. Drive IC

All of the organic EL display devices described above (the organic EL panel module and the driving condition control section) can be each formed on a single panel. Alternatively, a processing circuit portion and a pixel matrix may be manufactured separately for distribution.

For example, a driver IC block and a driving condition control section may be manufactured as each independent drive IC (integrated circuit), and the results may be distributed separately from an organic EL panel. Surely, the driver IC block and the driving condition control section may configure a single drive IC.

b. Display Module

Figure 20:
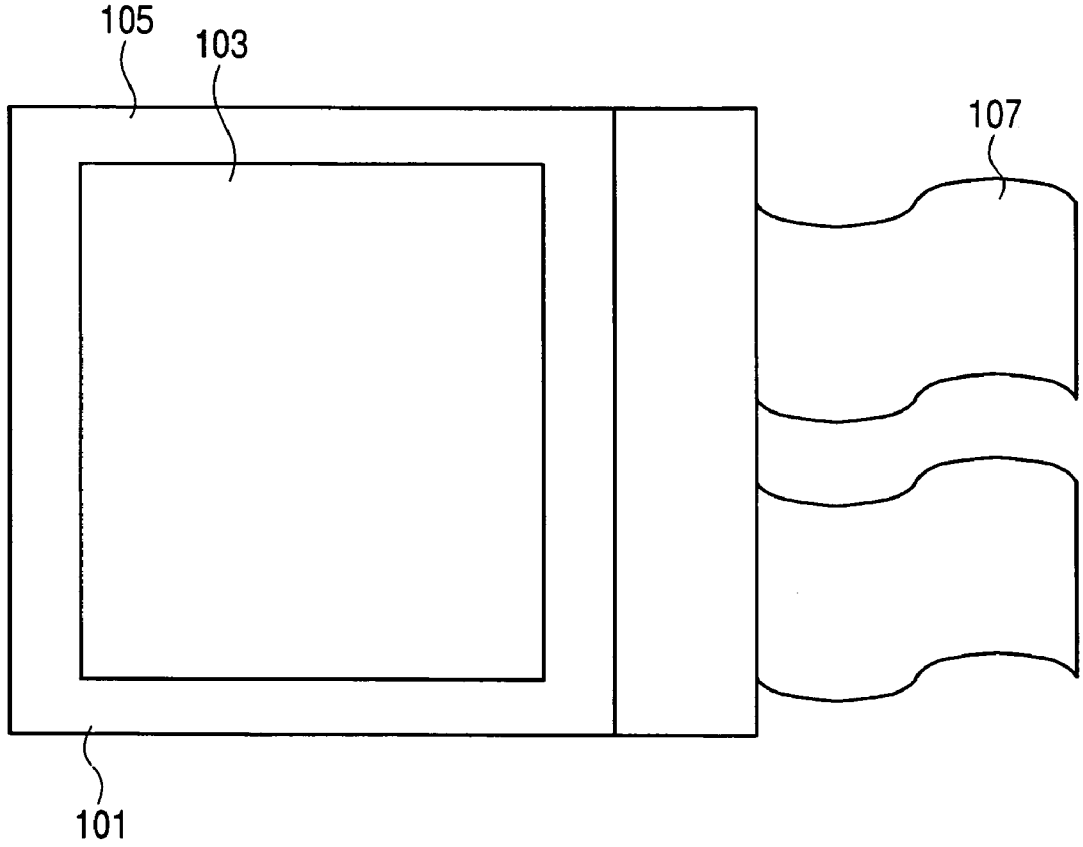
FIG. 20 is a diagram showing an exemplary configuration of a display module.

The organic EL display device in the above embodiments may be distributed in the form of a display module 101 having the outer appearance of FIG. 20.

The display module 101 is of configuration in which an opposing section 103 is affixed to the surface of a support substrate 105. The opposing section 103 is made of a transparent material such as glass, for example, and the surface thereof carries thereon a color filter, a protection film, a light shielding film, and other components.

Alternatively, the display module 101 may be provided with a FPC (Flexible Printed Circuit) 107 or other components for signal input/output from outside to the support substrate 105, for example.

c. Electronic Device

The organic EL display device in the above embodiments may be put on the market while being equipped in an electronic device.

Figure 21:
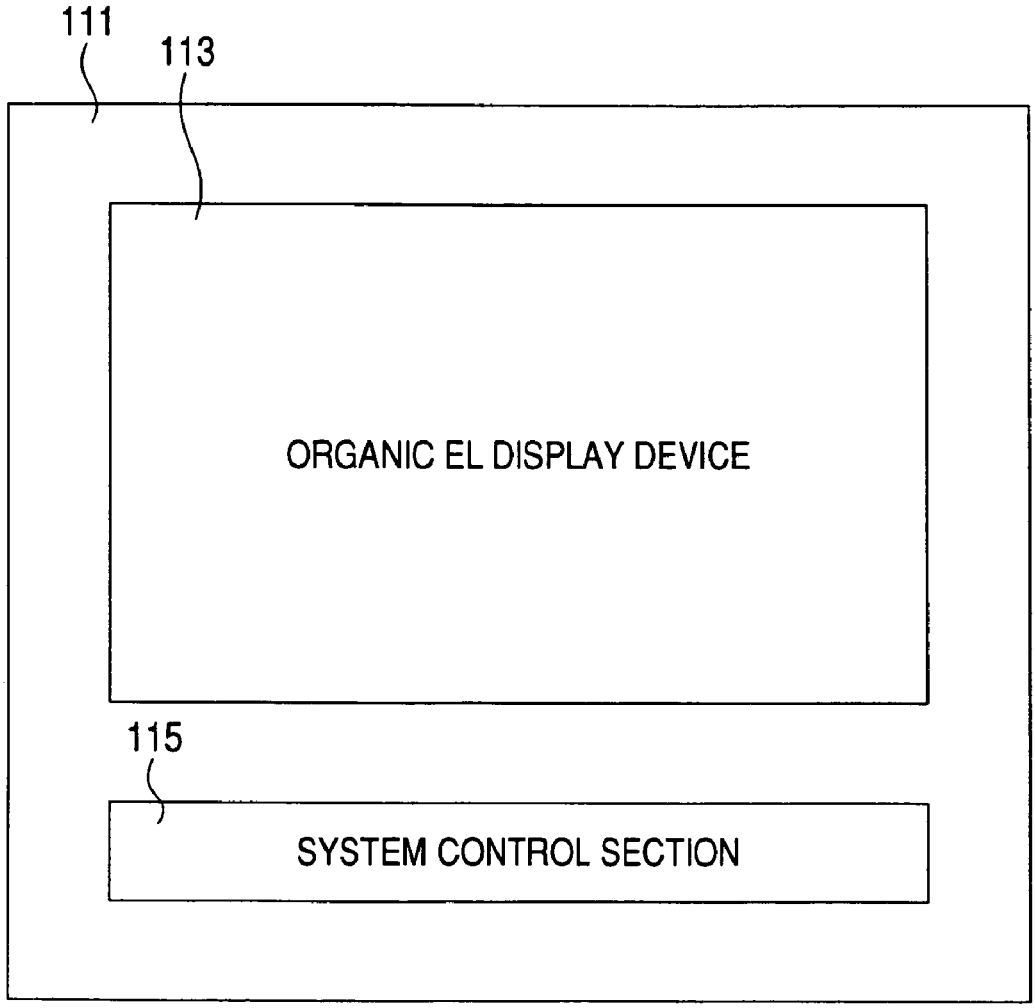
FIG. 21 is a diagram showing an exemplary function configuration of an electronic device.

FIG. 21 shows an exemplary conceptual configuration of an electronic device 111. The electronic device 111 is configured to include an organic EL display device 113 and a system control section 115 described above. The details of processing to be executed by the system control section 115 are varied depending on the product type of the electronic device 111.

Note that the electronic device 111 is not restricted in type of field as long as it is provided with a function of displaying images and videos generated in the device or provided from outside.

Figure 22:
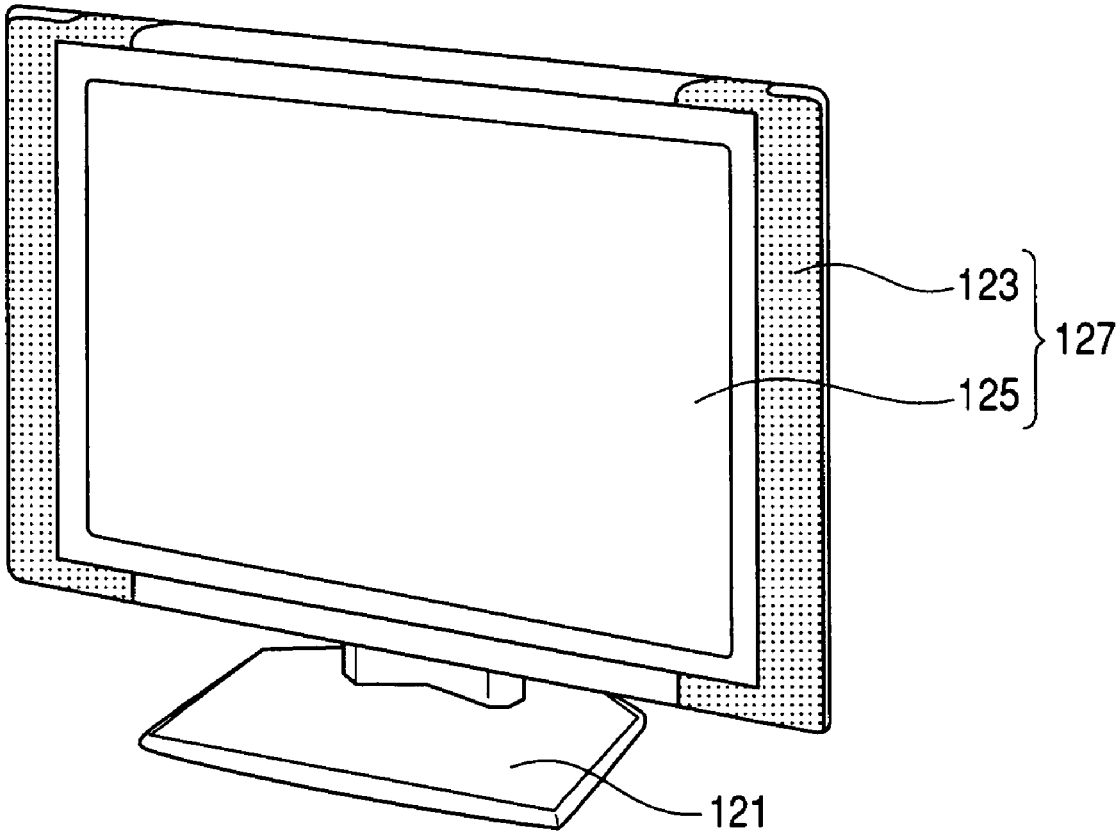
FIG. 22 is a diagram showing a product example of the electronic device.

The electronic device 111 of this type includes a television receiver, for example. FIG. 22 shows an exemplary outer appearance of a television receiver 121.

In the front of the chassis of the television receiver 121, a display screen 127 configured to include a front panel 123, a filter glass 125, and other components are disposed. The portion of the display screen 127 corresponds to the organic EL display device described in the embodiments.

Figure 23A:
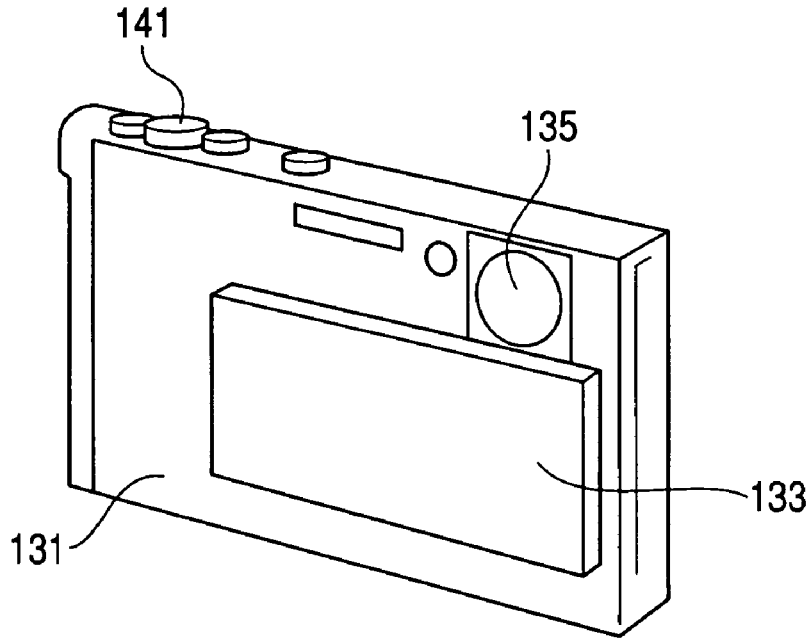
FIGS. 23A and 23B are each a diagram showing another product example of the electronic device.
Figure 23B:
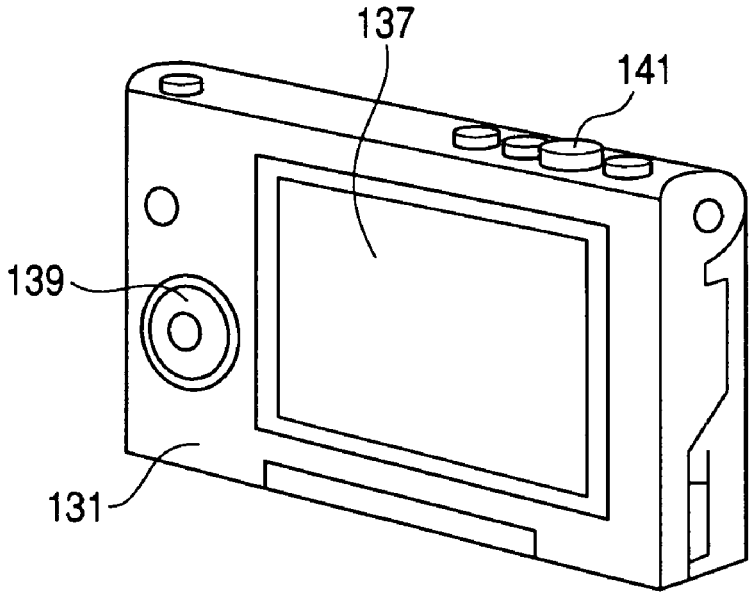

The electronic device 111 of this type is exemplified by a digital camera. FIGS. 23A and 23B each show an exemplary outer appearance of a digital camera 131. FIG. 23A shows an exemplary outer appearance on the front side (object side), and FIG. 23B shows an exemplary outer appearance on the rear side (user side).

The digital camera 131 is configured to include an imaging lens, a flash-use light emission section 135, a display screen 137, a control switch 139, and a shutter button 141. The imaging lens is disposed on the rear surface side of the protection cover 133 because the protection cover 133 is closed in FIG. 23A. Among these components, the portion of the display screen 137 corresponds to the organic EL display device described in the embodiments.

Figure 24:
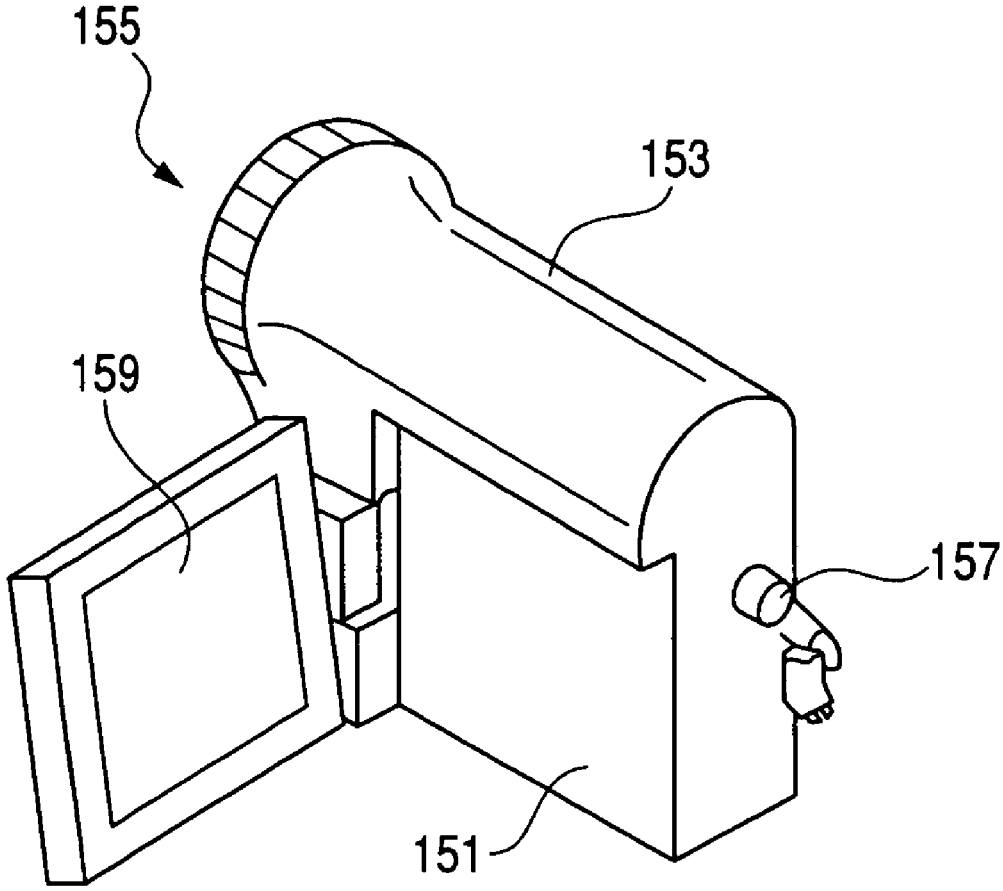
FIG. 24 is a diagram showing still another product example of the electronic device.

The electronic device 111 of this type is also exemplified by a video camera. FIG. 24 shows an exemplary outer appearance of a video camera 151.

The video camera 151 is configured to include an imaging lens 155, an imaging start/stop switch 157, and a display screen 159. The imaging lens 155 is disposed in front of a body 153 for imaging an object. Among these components, the portion of the display screen 159 corresponds to the organic EL display device described in the embodiments.

Figure 25A:
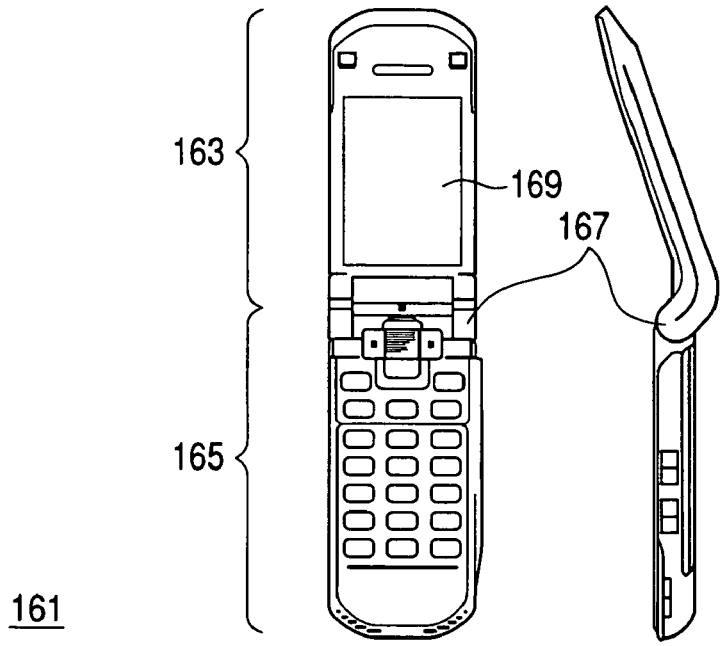
FIGS. 25A and 25B are each a diagram showing still another product example of the electronic device.
Figure 25B:
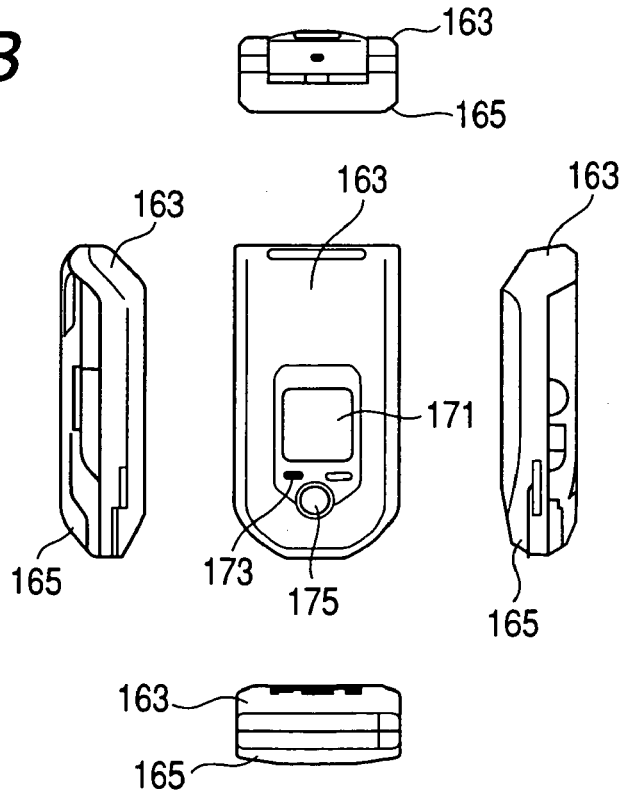

The electronic device 111 of this type is also exemplified by a mobile terminal device. FIGS. 25A and 25B each show an exemplary outer appearance of a mobile phone 161 as a mobile terminal device. The mobile phone 161 of FIGS. 25A and 25B is of a folding type; FIG. 25A shows an exemplary outer appearance in the state in which the chassis is opened, and FIG. 25B shows an exemplary outer appearance in the state in which the chassis is folded.

The mobile phone 161 is configured to include an upper chassis 163, a lower chassis 165, a coupling section (hinge section in this example) 167, a display screen 169, an auxiliary display screen 171, a picture light 173, and an imaging lens 175. Among these components, a portion of the display screen 169 and a portion of the auxiliary display screen 171 are those corresponding to the organic EL display device described in the embodiments.

Figure 26:
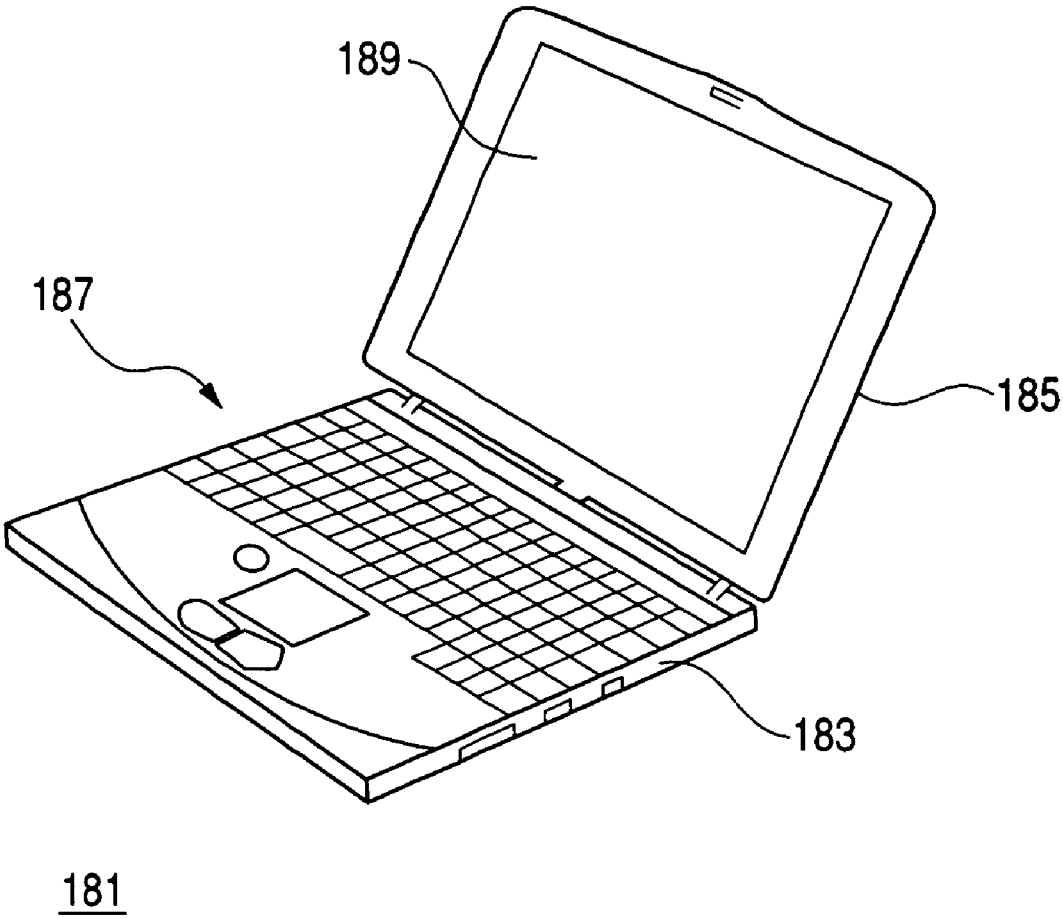
FIG. 26 is a diagram showing still another product example of the electronic device.

The electronic device 111 of this type is also exemplified by a computer. FIG. 26 shows an exemplary outer appearance of a notebook computer 181.

The notebook computer 181 is configured to include a lower chassis 183, an upper chassis 185, a keyboard 187, and a display screen 189. Among these, a portion of the display screen 189 corresponds to the organic EL display device described in the embodiments.

Other than that, the electronic device 111 also is exemplified by an audio reproduction device, a game machine, an electronic book, an electronic dictionary, and others.

B-8. Other Examples of Display Device

In the embodiments, the case in which a driving condition control section is equipped to an organic EL display device is described.

This is surely not restrictive, and a driving condition control section also can be applied also to other self light-emitting display devices, e.g. an inorganic EL a display device, a display device carrying therein an LED (Light-Emitting Diode), a FED display device, and a PDP (Plasma Display Panel) display device.

B-9. Configuration of Control Device

In the description above, the case of implementing a driving condition control section in view of hardware is described.

Alternatively, the driving condition control section may be partially or entirely implemented as a software process.

B-10. Others

While the invention has been described in detail, the foregoing description is in all aspects illustrative and not restrictive.

It should be understood by those skilled in the art that various modifications, combinations, subcombinations and alterations may occur depending on design requirements and other factors insofar as they are within the scope of the appended claims or the equivalents thereof.

What is claimed is:

1. A peak intensity level control device that controls a peak intensity level in a self light-emitting display module of active matrix driving type, the device comprising:

an average picture value calculation section that calculates an average picture value of display data to be supplied to the self light-emitting display module;

a driving condition control section that controls, at a time of performing intensity-up driving with respect to the peak intensity level, a driving condition of the self light-emitting display module so as to be able to derive the peak intensity level suited for the average picture value; and a gamma change section that applies, at the time of performing the intensity-up driving with respect to the peak intensity level, a gamma change to the display data so as not to increase power consumption compared with driving with the peak intensity level of a standard value.

2. The peak intensity level control device according to claim 1, wherein the average picture value calculation section calculates the average picture value for an arbitrary frame.

3. The peak intensity level control device according to claim 1, wherein the average picture value calculation section calculates the average picture value for the display data provided during a fixed length of time.

4. The peak intensity level control device according to claim 1, wherein the average picture value calculation section calculates the average picture value for every frame.

5. The peak intensity level control device according to claim 1, wherein the gamma change section executes a gamma change process based on the average picture value of the display data designed for the self light-emitting display module.

6. The peak intensity level control device according to claim 1, wherein the gamma change section stops, at the time of the intensity-up driving with respect to the peak intensity level corresponding to the average picture value, when the power consumption shows a decrease compared with the driving with the standard value, the gamma change to the display data, and applies, at the time of the intensity-up driving with respect to the peak intensity level corresponding to the average picture value, when the power consumption shows an increase compared with the driving with the standard value, the gamma change to the display data to reduce an amount of increase of the power consumption.

7. A self light-emitting display device, comprising:

a self light-emitting display module with a pixel configuration of active matrix driving type;

an average picture value calculation section that calculates an average picture value of display data to be supplied to the self light-emitting display module;

a driving condition control section that controls, at a time of performing intensity-up driving with respect to a peak intensity level, a driving condition of the self light-emitting display module so as to be able to derive the peak intensity level suited for the average picture value; and a gamma change section that applies, at the time of performing the intensity-up driving with respect to the peak intensity level, a gamma change to display data not to increase power consumption compared with driving with the peak intensity level of a standard value.

8. The self light-emitting display device according to claim 7, wherein a pixel is configured by an electroluminescent element.

9. An electronic device, comprising:

a self light-emitting display module with a pixel configuration of active matrix driving type;

a driving condition control section that controls, at a time of performing intensity-up driving with respect to a peak intensity level, a driving condition of the self light-emitting display module so as to be able to derive the peak intensity level suited for the average picture value;

a gamma change section that applies, at the time of performing the intensity-up driving with respect to the peak intensity level, a gamma change to display data so as not to increase power consumption compared with driving with the peak intensity level of a standard value; and a system control section.

10. A driving condition control method of controlling a peak intensity level in a self light-emitting display module of active matrix driving type, the method comprising the steps of:

calculating an average picture value of display data to be supplied to the self light-emitting display module;

controlling, at a time of performing intensity-up driving with respect to the peak intensity level, a driving condition of the self light-emitting display module so as to be able to derive the peak intensity level suited for the average picture value; and applying, at the time of performing the intensity-up driving with respect to the peak intensity level, a gamma change to display data so as not to increase power consumption compared with driving with the peak intensity level of a standard value.

11. A computer program product for allowing a computer to control a peak intensity level in a self light-emitting display module of active matrix driving type, the computer program product comprising a non-transitory computer readable medium having program code stored thereon, the program code being executable to perform operations comprising:

calculating an average picture value of display data to be supplied to the self light-emitting display module;

controlling, at a time of performing intensity-up driving with respect to the peak intensity level, a driving condition of the self light-emitting display module so as to be able to derive the peak intensity level suited for the average picture value; and applying, at the time of performing the intensity-up driving with respect to the peak intensity level, a gamma change to display data so as not to increase power consumption compared with driving with the peak intensity level of a standard value.

* * * * *